US009569929B2

(12) United States Patent
Arnone et al.

(10) Patent No.: US 9,569,929 B2
(45) Date of Patent: Feb. 14, 2017

(54) SYSTEMS FOR AN INTERMEDIATE VALUE HOLDER

(71) Applicant: Gamblit Gaming, LLC, Glendale, CA (US)

(72) Inventors: Miles Arnone, Sherborn, MA (US); Eric Meyerhofer, Pasadena, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/708,161

(22) Filed: May 8, 2015

(65) Prior Publication Data

US 2015/0243130 A1 Aug. 27, 2015

Related U.S. Application Data

(63) Continuation of application No. PCT/US2013/067354, filed on Oct. 29, 2013.

(60) Provisional application No. 61/723,866, filed on Nov. 8, 2012.

(51) Int. Cl.
*G07F 17/32* (2006.01)

(52) U.S. Cl.
CPC ..... *G07F 17/3244* (2013.01)

(58) Field of Classification Search
CPC ..... G07F 17/3244
USPC ..... 463/10, 25
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |
| 6,685,563 | B1 | 2/2004 | Meekins et al. |
| 6,712,693 | B1 | 3/2004 | Hettinger |
| 6,761,632 | B2 | 7/2004 | Bansemer et al. |
| 6,761,633 | B2 | 7/2004 | Riendeau |
| 6,764,397 | B1 | 7/2004 | Robb |
| 6,811,482 | B2 | 11/2004 | Letovsky |
| 7,118,105 | B2 | 10/2006 | Benevento |
| 7,294,058 | B1 | 11/2007 | Slomiany |
| 7,326,115 | B2 | 2/2008 | Baerlocher |

(Continued)

FOREIGN PATENT DOCUMENTS

| | | | |
|---|---|---|---|
| WO | 2011/109454 A1 | 9/2011 | |
| WO | WO 2011109454 A1 * | 9/2011 | ..... G07F 17/3272 |

OTHER PUBLICATIONS

U.S. Appl. No. 14/185,847 Arnone, et al., filed Feb. 20, 2014.

(Continued)

*Primary Examiner* — Omkar Deodhar
*Assistant Examiner* — Shauna-Kay Hall
(74) *Attorney, Agent, or Firm* — Frank Cire

(57) ABSTRACT

Systems for providing an intermediate value holder in a gambling hybrid game are disclosed. The intermediate value holder may be used to change a set of variables in an entertainment game provided the gambling hybrid game. The intermediate value holder may be obtained as the result of a gambling event or by the expenditure of a form of credit by the player.

8 Claims, 16 Drawing Sheets

(56) References Cited

U.S. PATENT DOCUMENTS 7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0077994 A1* 4/2007 Betteridge ..... G07F 17/32 463/42
2007/0082729 A1* 4/2007 Letovsky ..... A63F 13/10 463/23
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275411 A1 11/2009 Kisenwether et al.
2009/0291755 A1 11/2009 Walker et al.

(56) References Cited

U.S. PATENT DOCUMENTS

| | | | | |
|---|---|---|---|---|
| 2009/0309305 | A1 | 12/2009 | May | |
| 2009/0312093 | A1 | 12/2009 | Walker et al. | |
| 2009/0325686 | A1 | 12/2009 | Davis | |
| 2010/0004058 | A1 | 1/2010 | Acres | |
| 2010/0016056 | A1 | 1/2010 | Thomas et al. | |
| 2010/0029373 | A1 | 2/2010 | Graham et al. | |
| 2010/0035674 | A1 | 2/2010 | Slomiany | |
| 2010/0056247 | A1 | 3/2010 | Nicely | |
| 2010/0056260 | A1 | 3/2010 | Fujimoto | |
| 2010/0062836 | A1 | 3/2010 | Young | |
| 2010/0093420 | A1 | 4/2010 | Wright | |
| 2010/0093444 | A1 | 4/2010 | Biggar et al. | |
| 2010/0105454 | A1 | 4/2010 | Weber | |
| 2010/0120525 | A1 | 5/2010 | Baerlocher et al. | |
| 2010/0124983 | A1 | 5/2010 | Gowin et al. | |
| 2010/0137047 | A1 | 6/2010 | Englman et al. | |
| 2010/0174593 | A1 | 7/2010 | Cao | |
| 2010/0184509 | A1 | 7/2010 | Sylla et al. | |
| 2010/0203940 | A1 | 8/2010 | Alderucci et al. | |
| 2010/0210344 | A1 | 8/2010 | Edidin et al. | |
| 2010/0227672 | A1 | 9/2010 | Amour | |
| 2010/0227688 | A1 | 9/2010 | Lee | |
| 2010/0240436 | A1 | 9/2010 | Wilson et al. | |
| 2010/0304825 | A1 | 12/2010 | Davis | |
| 2010/0304839 | A1 | 12/2010 | Johnson | |
| 2010/0304842 | A1 | 12/2010 | Friedman et al. | |
| 2011/0009177 | A1 | 1/2011 | Katz | |
| 2011/0009178 | A1 | 1/2011 | Gerson | |
| 2011/0045896 | A1 | 2/2011 | Sak et al. | |
| 2011/0077087 | A1 | 3/2011 | Walker et al. | |
| 2011/0082571 | A1 | 4/2011 | Murdock et al. | |
| 2011/0105206 | A1 | 5/2011 | Rowe et al. | |
| 2011/0107239 | A1 | 5/2011 | Adoni | |
| 2011/0109454 | A1 | 5/2011 | McSheffrey | |
| 2011/0111820 | A1 | 5/2011 | Filipour | |
| 2011/0111837 | A1 | 5/2011 | Gagner | |
| 2011/0111841 | A1 | 5/2011 | Tessmer | |
| 2011/0118011 | A1 | 5/2011 | Filipour et al. | |
| 2011/0201413 | A1 | 8/2011 | Oberberger | |
| 2011/0207523 | A1 | 8/2011 | Filipour et al. | |
| 2011/0212766 | A1 | 9/2011 | Bowers | |
| 2011/0212767 | A1 | 9/2011 | Barclay | |
| 2011/0218028 | A1 | 9/2011 | Acres | |
| 2011/0218035 | A1 | 9/2011 | Thomas | |
| 2011/0230258 | A1 | 9/2011 | Van Luchene | |
| 2011/0230260 | A1 | 9/2011 | Morrow et al. | |
| 2011/0230267 | A1 | 9/2011 | Van Luchene | |
| 2011/0244944 | A1 | 10/2011 | Baerlocher | |
| 2011/0263312 | A1 | 10/2011 | De Waal | |
| 2011/0269522 | A1 | 11/2011 | Nicely et al. | |
| 2011/0275440 | A1 | 11/2011 | Faktor | |
| 2011/0287828 | A1 | 11/2011 | Anderson et al. | |
| 2011/0287841 | A1 | 11/2011 | Watanabe | |
| 2011/0312408 | A1 | 12/2011 | Okuaki | |
| 2011/0319169 | A1 | 12/2011 | Lam | |
| 2012/0004747 | A1 | 1/2012 | Kelly | |
| 2012/0028718 | A1 | 2/2012 | Barclay et al. | |
| 2012/0058814 | A1 | 3/2012 | Lutnick | |
| 2012/0077569 | A1 | 3/2012 | Watkins | |
| 2012/0108323 | A1 | 5/2012 | Kelly | |
| 2012/0135793 | A1 | 5/2012 | Antonopoulos | |
| 2012/0202587 | A1 | 8/2012 | Allen | |
| 2012/0302311 | A1 | 11/2012 | Luciano | |
| 2012/0322545 | A1* | 12/2012 | Arnone | G07F 17/3272 463/25 |
| 2013/0029760 | A1 | 1/2013 | Wickett | |
| 2013/0053118 | A1* | 2/2013 | Schueller | G07F 17/3218 463/17 |
| 2013/0131848 | A1 | 5/2013 | Arnone et al. | |
| 2013/0190074 | A1 | 7/2013 | Arnone et al. | |
| 2013/0260869 | A1 | 10/2013 | Basallo et al. | |
| 2014/0087801 | A1 | 3/2014 | Nicely et al. | |
| 2014/0087808 | A1 | 3/2014 | Basallo et al. | |
| 2014/0087809 | A1 | 3/2014 | Leupp et al. | |

OTHER PUBLICATIONS

U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.

(56) References Cited

OTHER PUBLICATIONS

U.S. Appl. No. 14/703,721 Arnone, et al. filed May 4, 2015.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.

* cited by examiner

SYSTEMS FOR AN INTERMEDIATE VALUE HOLDER

CROSS-REFERENCE TO RELATED APPLICATIONS

This application is a continuation of Patent Cooperation Treaty Application No. PCT/US13/67354, filed Oct. 29, 2013 which claims the benefit of U.S. Provisional Applications No. 61/723,866, filed Nov. 8, 2012 and 61/734,891 filed Dec. 7, 2012, the disclosure of each of which is incorporated herein by reference as if set forth herewith.

FIELD OF THE INVENTION

Embodiments of the present invention are generally related to gaming and more specifically to systems and processes that provide a gambling hybrid game in which the results of real world credits and the winnings from wagers may be used to change properties in an entertainment game.

BACKGROUND

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a WHO or a PC based.

SUMMARY OF THE INVENTION

In many embodiments, a server is constructed to execute a wager in accordance with a gambling proposition and contain the auditable systems and functions enabling gaming regulatory body approval. However, the wager is to be initiated by, and the result of the wager is to be communicated to, a computing device in an environment that is separate from server and its auditable systems and functions enabling gaming regulatory body approval. A controller is used to interface between the server and its auditable systems and the computing device in its separate environment.

In an embodiment, a network distributed processing system comprises a mobile computing device connected to a controller by a network, wherein the mobile computing device is configured to: execute an interactive entertainment game of skill for a player; communicate to the controller via the network, a status update about the interactive entertainment game of skill; receive from the controller via the network, a change in a set of entertainment variables of the interactive entertainment game of skill; and incorporate into the interactive entertainment game of skill, the change in the set of entertainment variables of the interactive entertainment game of skill. A server is connected to the controller via a communication link, and the server is constructed to: receive from the controller via the communication link, a trigger of a gambling event of a wager of real world credits; execute the wager of real world credits in accordance with a regulated gambling proposition to determine a result of the gambling event; and communicate to the controller via the communication link, the result of the gambling event. The controller is connected to the mobile computing device by the network and connected to the server by the communication link, wherein the controller is configured to: receive from the mobile computing device via the network, the status update about the interactive entertainment game of skill; determine the trigger of the gambling event using the status update about the entertainment game; communicate to the server via the communication link, the trigger of the gambling event; receive from the server via the communication link, the result of the gambling event; determine an amount of an intermediate value holder to provide to the player based on the result of the gambling event; provide the amount of the intermediate value holder to a process that converts a certain amount of the intermediate value holder to the change in a set of entertainment variables of the interactive entertainment game of skill; and communicate to the mobile computing device via network, the change in the set of entertainment variables of the interactive entertainment game of skill.

In some embodiments, the controller is constructed to perform the process to convert the certain amount of intermediate value holder into the change in the set of entertainment variables.

In various embodiments, the mobile computing device is constructed to perform the process to convert the certain amount of intermediate value holder into the change in the set of entertainment variables.

In several embodiments, the controller further is constructed to update a player account with the amount of intermediate value holder obtained based on the result of the gambling event.

In many embodiments, the process to convert the certain amount of the intermediate value holder into a change in the set of entertainment game variables bases the conversion on an input from at least one of a player management system, gambling hybrid game logic, and a third party system.

In several embodiments, the controller is further constructed to convert a certain amount of the intermediate value holder to a certain amount of at least one of real world credits and game world credits.

In some embodiments, the controller and the server are constructed from a same processing apparatus.

In many embodiments, the controller and the server are constructed from different processing apparatuses, and wherein the communication link utilizes the network.

DETAILED DISCLOSURE OF THE INVENTION

Turning now to the drawings, systems and methods for providing an intermediate value holder for the results of gambling events and using the intermediate value holders to change a set of variables in a gambling hybrid game in accordance with some embodiments of the invention are illustrated. In accordance with many embodiments of the invention, the result of a gambling event in a gambling hybrid game, rather than being converted directly into the same element of the entertainment game that initiated the wager in the first place, is converted into an intermediate quantity. The intermediate quantity, herein after referred to as "quanta", that results from the gambling event is determined according to a formula or formulae embedded within the system. Quanta, may or may not be observable to the player as part of the gambling hybrid game play and may ultimately be converted into one or more elements for use within the entertainment game portion of the gambling hybrid game. In addition, quanta may also in some instances, though it needs not be, be converted into real world credits, game world credits, universal game world credits, and the like.

In accordance with some embodiments of the invention, the provision of quanta based on the results of gambling events may only be triggered upon the player initiating the quanta option that permits the quanta conversion of gambling events. The initiation may be done by the player expending real world credits and/or game world credits. In accordance with some embodiments, the provision of quanta may be strictly through the purchasing of quanta using real world credits, game world credits, or the like.

Gambling Hybrid Games

Figure 1:
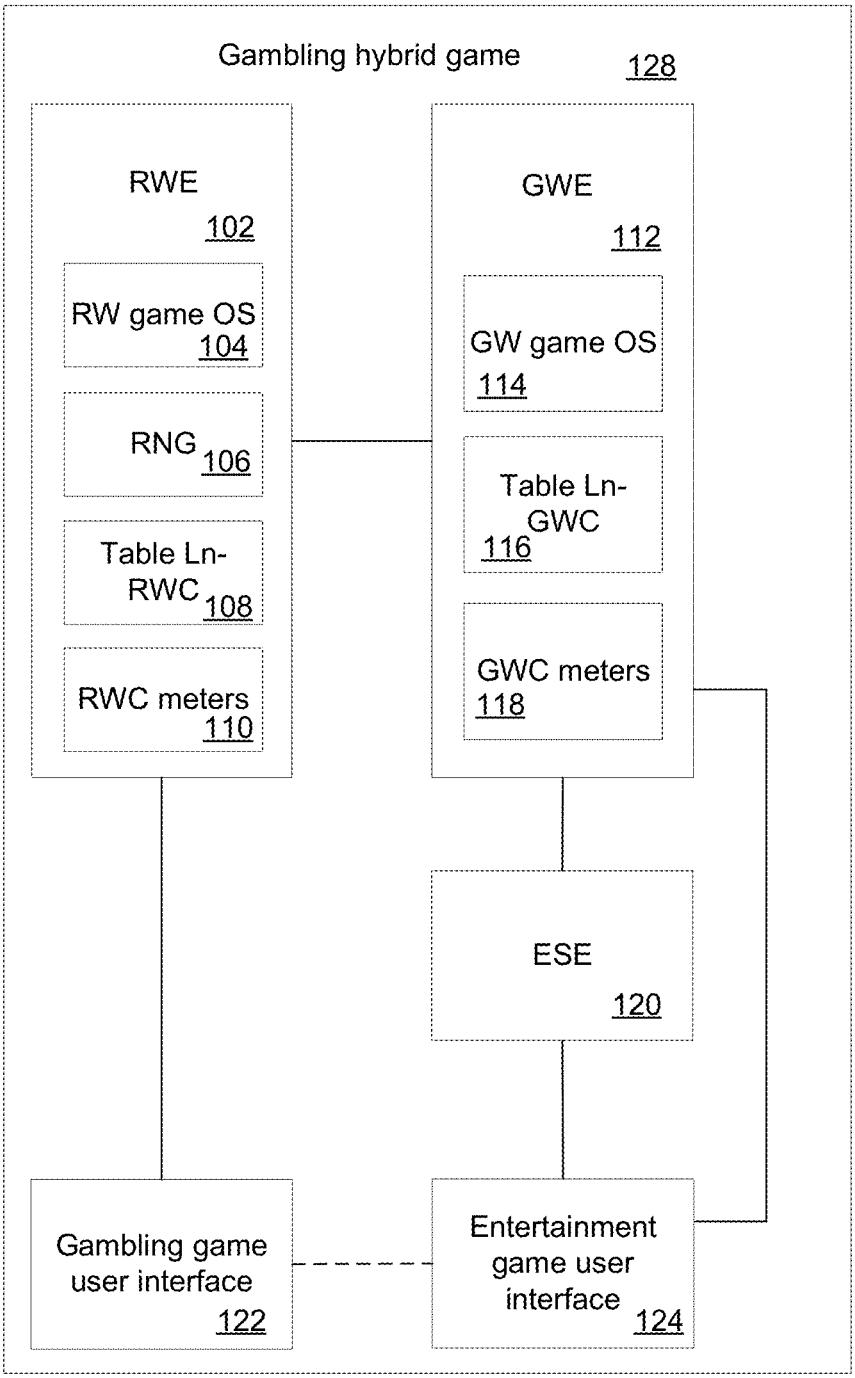
FIG. 1 illustrates a conceptual diagram of components of a gambling hybrid game in accordance with an embodiment of the invention.

In accordance with many embodiments of the invention, a gambling hybrid game integrates high-levels of entertainment content with a game of skill (entertainment game) and a gambling experience with a game of chance (gambling game). A gambling hybrid game provides for random outcomes independent of player skill while providing that the user's gaming experience (as measured by obstacles/challenges encountered, time of play and other factors) is shaped by the player's skill. The outcome of a gambling proposition that is determined by a Random Number Generator (RNG) or other such device that provides a random outcome in response to a request. In accordance with some embodiments, the wager game may be initiated in response to a game object related player action. A gambling hybrid game in accordance with an embodiment of the invention is illustrated in FIG. 1. The gambling hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the gambling hybrid game 128 and controls and operates the gambling game. The operation of a gambling game is enabled by Real World Currency (RC), such as money or other real world funds. A gambling game can increase or decrease an amount of RC based on random gambling outcomes, where the gambling proposition of a gambling game is typically regulated by gaming control bodies. In many embodiments, the RWE includes a Real World (RW) operating system (OS) 104, RNG 106, level n real-world credit pay tables (table Ln-RC) 108, RC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (table Ln-RC) 108 is a table that can be used in conjunction with a random number generator (RNG) 106 to dictate the RC earned as a function of sponsored gameplay and is analogous to the pay tables used in a conventional slot machine. Table Ln-RC payouts are independent of player skill. There can be one table or multiple tables included in Ln-RC pay tables 108 contained in a gambling game, the selection of which can be determined by factors including (but not limited to) game progress that a player has earned, and/or bonus rounds for which a player can be eligible. RCs are credits analogous to slot machine game credits, which are entered into a gambling game by the user, either in the form of money such as hard currency or electronic funds. RCs can be decremented or augmented based on the outcome of a random number generator according to the table Ln-RC real world credits pay table 108, independent of player skill. In certain embodiments, an amount of RC can be used as criteria in order to enter higher ESE game levels. RC can be carried forward to higher game levels or paid out if a cash out is opted for by a player. The amount of RC used to enter a specific level of the game level n need not be the same for each level.

In accordance with some embodiments of the invention, the GWE 112 manages the overall gambling hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an operating system (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RC available on the game and other metrics of wagering on the gambling game (and potentially affect the amount of RC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In accordance with some embodiments, a level n game world credit pay table (Table Ln-GWC) 116 dictates the game world credit (GWC) earned as a function of player skill in the nth level of the game. The payouts governed by this table are dependent upon player skill and sponsored gameplay at large and can or cannot be coupled to a RNG. In accordance with some embodiments, GWCs are player points earned or depleted as a function of player skill, specifically as a function of player performance in the context of the game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In accordance with various embodiments of the invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of a draw certificate based gambling hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting portions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special portion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RC in play, and amount of RC available. The RWE 102 can accept modifications in the amount of RC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a gambling hybrid game integrates a video game style gambling machine, where the gambling game (including an RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the gambling hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, gambling hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
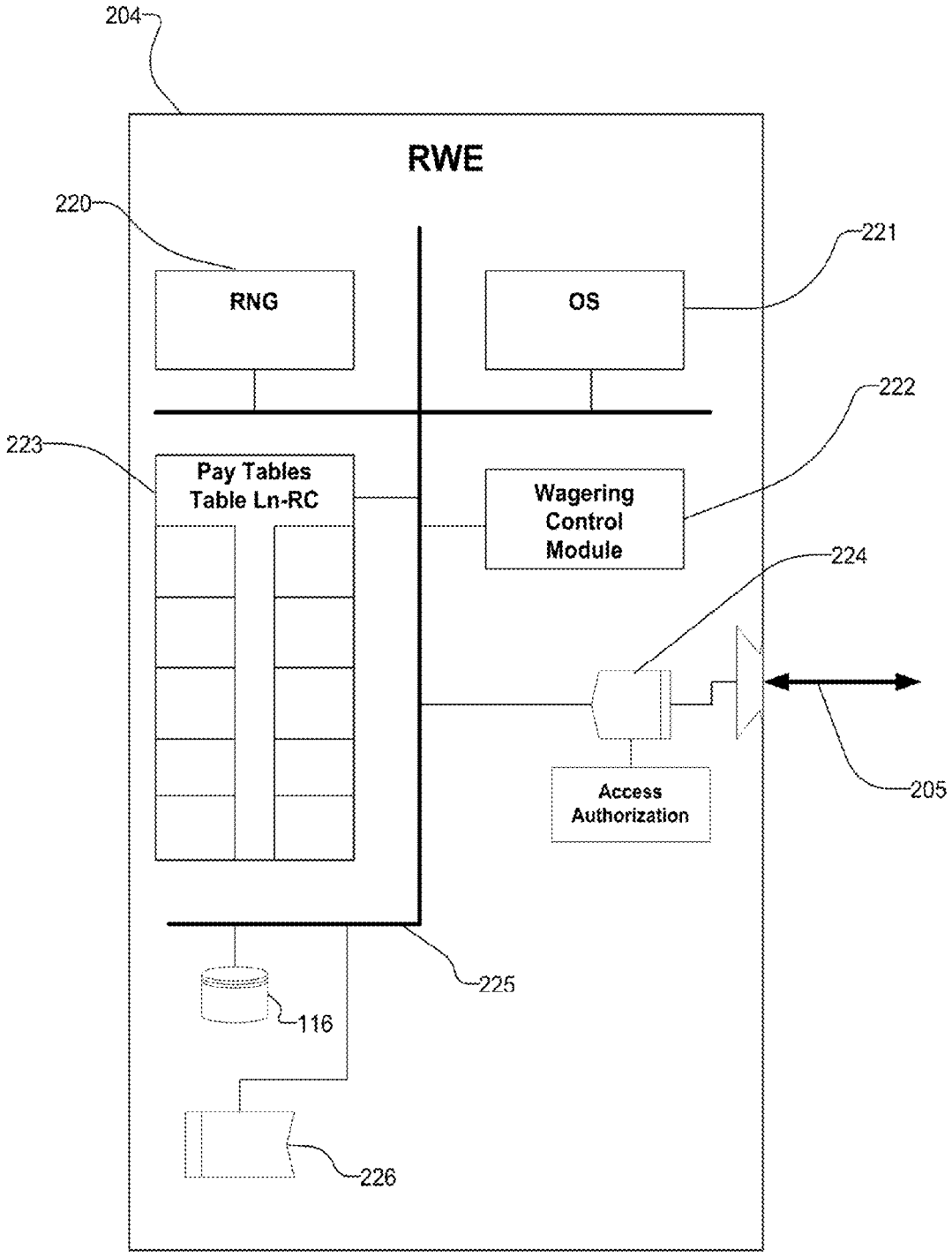
FIG. 2 illustrates a conceptual diagram of aspects of a Real World Engine (RWE) of a gambling hybrid game in accordance with some embodiments of the invention.

The components provided by the RWE for a gambling hybrid game in accordance with embodiments of the invention are shown in FIG. 2. In accordance with embodiments of the invention, the RWE includes an internal bus 225 that connects an operating system OS 221, a Random Number Generator ("RNG") 220, one or more pay tables (Table Ln-RC) 223 which would control the functions of the RWE, a Random Number Generator ("RNG") 220 to produce random numbers, one or more pay tables (Table Ln-RC) 223, a wagering control module 222, an authorization access module 224, and a RC credit meter 226 that are included in the RWE 204. The RW OS 221 controls the functions of the RWE. The RNG 220 includes one or more RNGs that are used to produce random numbers for use in resolving gambling events and other process requiring a random number to determine an outcome. The one or more pay tables (Table Ln-RC) 223 contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. A repository (a credit meter) 926 maintains a record of the amount of RC which player has deposited in the game and has been accumulated by the player.

An external connection allows the RWE 204 to interface to another system or device, which is shown in FIG. 2 as the internet 205 but may be any other network and/or device. The authorization access module 224 of RWE 204 is connected to the external connection and provides a method to permit access and command exchange between an external system and the RWE 904. The RWE 904 also contains storage for statuses, wagers, wager outcomes, meters and other historical events in a storage device 116.

Figure 3:
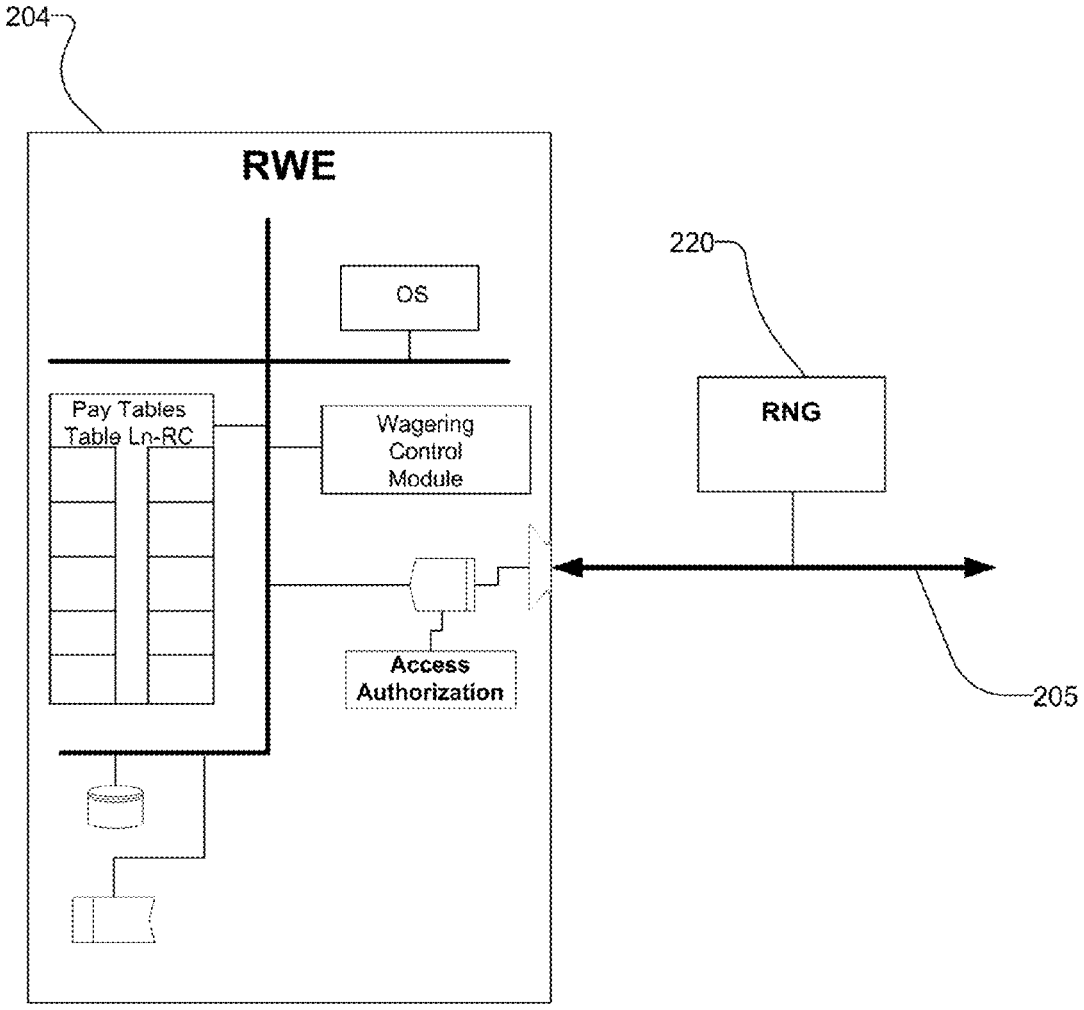
FIG. 3 illustrates a conceptual diagram of aspects of a Real World Engine of a gambling hybrid game in accordance with some other embodiments of the invention.

In some embodiments, the RWE communicates with external systems to provide various functions of a gambling hybrid game in accordance with embodiments of the invention. The components of an RWE that communicate with an external system to provide a component of the RWE in accordance with embodiments of the invention are shown in FIG. 3. The RWE 204 shown in FIG. 3 is similar to the RWE shown in FIG. 2. However, the RNG 220 which is an external system connected to the RWE 204 by the internet 905 in accordance with embodiments of the invention. The RNG 220 could be a central deterministic system, such as a regulated and controlled random numbered ball selection device, or some other system which provides random or pseudo random numbers to one or a plurality of connected RWEs 204. One skilled in the art will recognize that only RNG 220 is an external system in the shown embodiments. However, any of the components could be external systems without departing from the invention and RNG 220 is shown as an example only.

In FIGS. 2 and 3, the RWE 204 interfaces with other systems/devices or to an external RNG 220 using the Internet 205. However, one skilled in the art will note that nothing would preclude using a different interface than the internet 205 in other embodiments of the invention. Other examples of interfaces include, but are not limited to, a LAN, a USB interface, or some other method by which two electronic and software constructs could communicate with each other.

Figure 4:
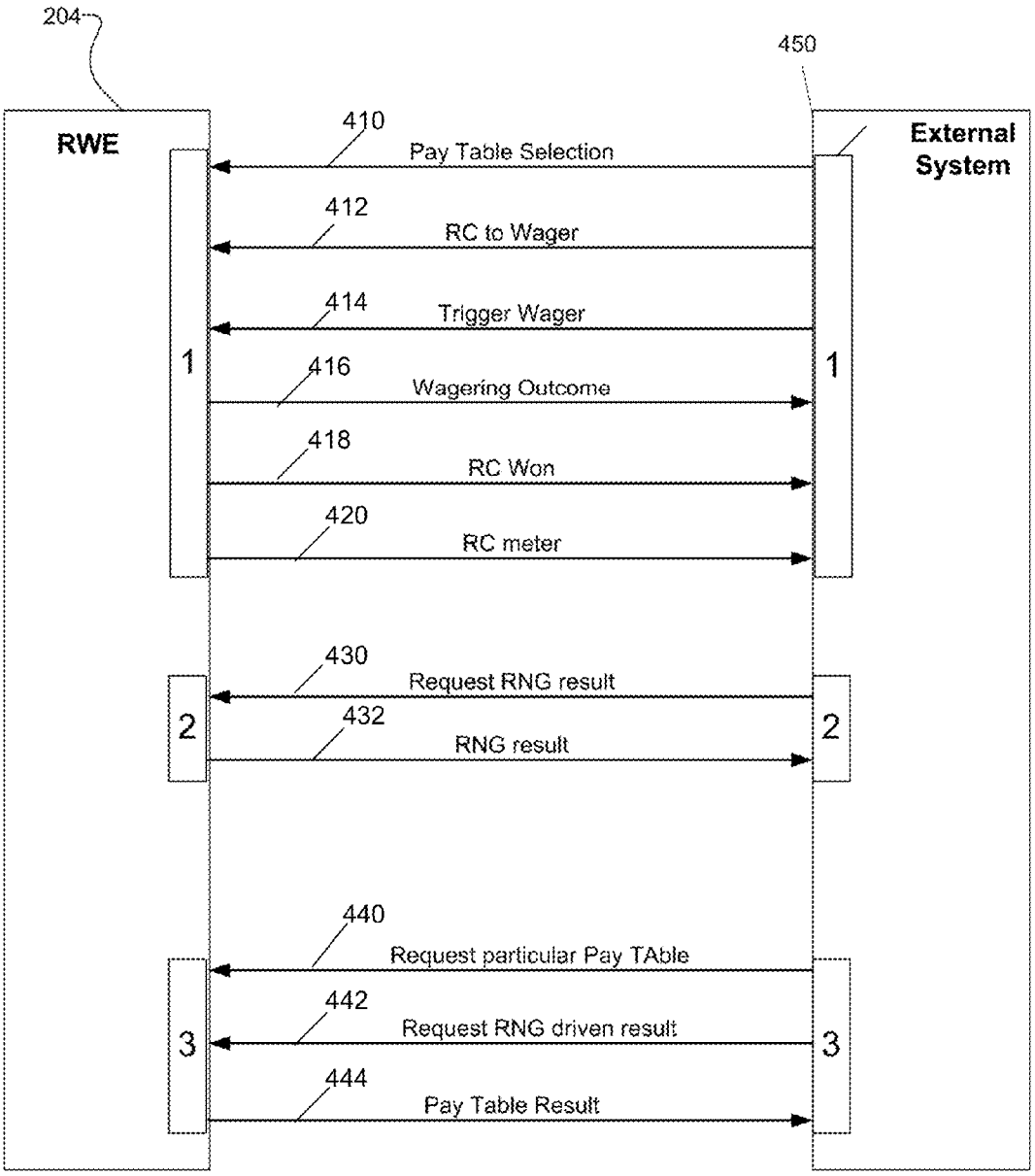
FIG. 4 illustrates a signaling diagram of communications between a Real World Engine (RWE) and an external system to provide various functions in accordance with embodiments of the invention.

The RWE and an external system typically communicate to provide the resolution of gambling events to resolve wagers on the events. The signals between the RWE and an external system to provide some process related to resolving gambling events in accordance with embodiments of the invention are shown in FIG. 4. In accordance with embodiments of the invention, the primary function of the RWE 204 is to manage wagering events and to provide random (or pseudo random) numbers from an RNG. At the top of the figure, a 6 component communication exchange grouped by the "1" box is shown for a wager on a proposition in a gambling event during a gambling hybrid game in accordance with embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of the invention that is shown in FIG. 4 is grouped by the "2" box in FIG. 4 and relates to the external system 450 needing an RNG result support from the RWE 204. In this exchange, the external system 450 requests an RNG result from the RWE 204 (430). The RWE 204 returns an RNG result to the external 450 in response to the request (432). The result may be generated as a function of the internal RNG in the RWE 204, or from an RNG external to the RWE 204 to which the RWE 204 is connected.

A third communication exchange between the RWE 204 and the external system 405 in accordance with embodiments of the invention that is shown in FIG. 4 is grouped by the "3" box in the figure and relates to the external system 450 wanting support on coupling an RNG result to a particular Pay Table contained in the RWE 204. In this exchange, the external system 450 instructs the RWE as to the pay table (Table Ln-RC) to use 450. The external system then requests a result whereby the RNG result is coupled to the requested Pay Table (442). The result is returned to the external system 405 by RWE 204 (444). Such an aspect is different from the first exchange shown by the box"1" sequence in that no actual RC wager is conducted. However, such a process t might be useful in coupling certain non-RC wagering entertainment game behaviors and propositions to the same final resultant wagering return which is understood for the gambling hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from the invention.

Figure 5:
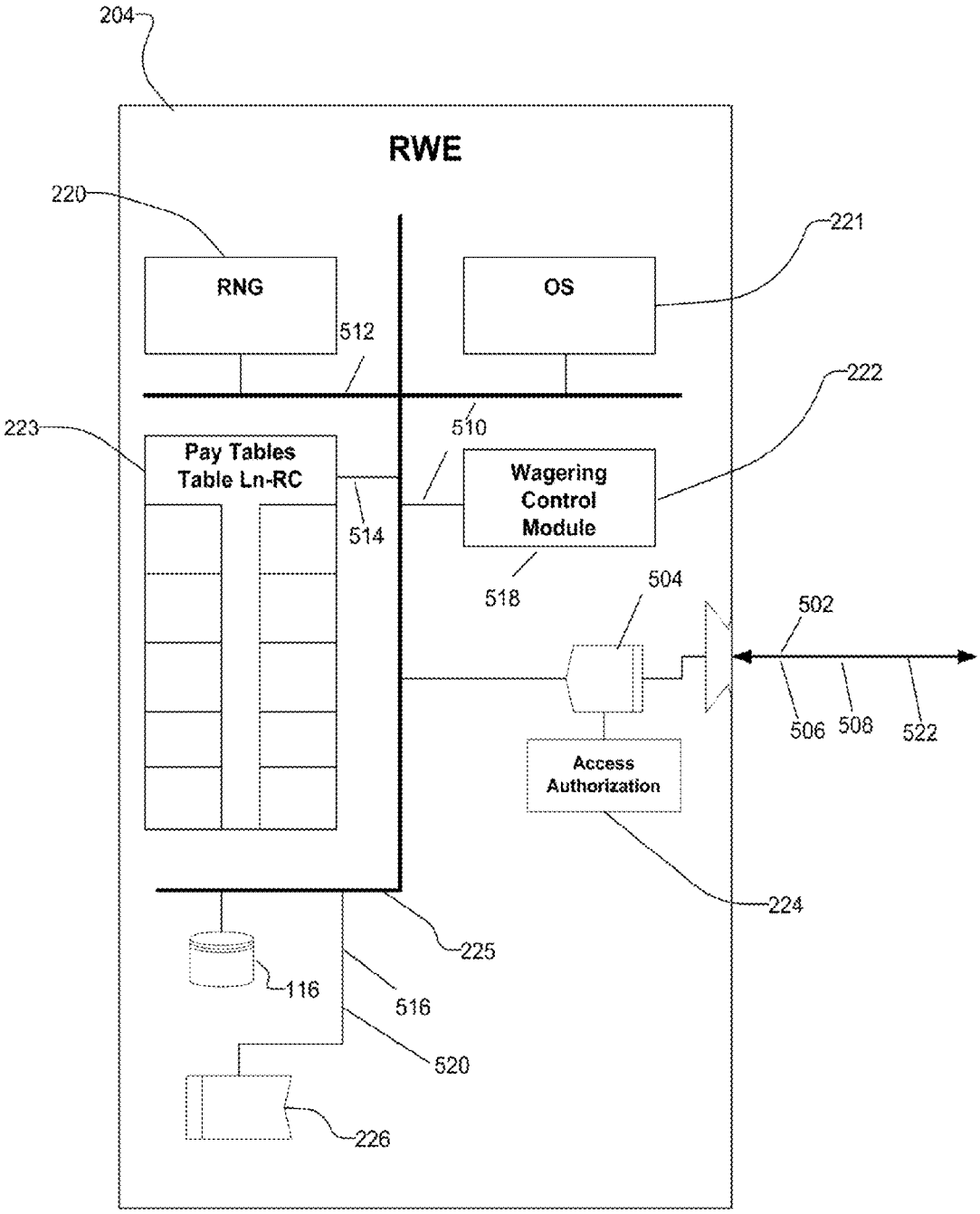
FIG. 5 illustrates a conceptual diagram of a process flow and signaling in a RWE to provide various functions in accordance with embodiments of the invention.

The process flow for functional communication exchanges, such as communication exchanges described above with reference to FIG. 4, between a RWE and an external system in accordance with embodiments of the invention are shown in FIG. 5. The process begins by a RWE 204 receiving signals from an external system requesting a connection to RWE 204. The Access Authorization Module determines that the external system authorized to connect to RWE 204 (504) and transmits an authorization response to the external system. The external systems that provide requests a request for a gambling event is to be performed to RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execute (510). In response to the request to execute the gambling event, the wager control module 222 requests an RNG result from the RNG 220 (512); retrieves a proper pay table or tables from the pay tables 223 (514); adjusts the RC of the player in the RC repository 926 as instructed (516; applies the RNG result to the particular pay table or tables (518); and multiplies the resultant factor from the Pay Table by the amount of RC to determine the result of the wager (518). Wager Control Module 222 then adds the amount of RC won by the wager to the RC repository 426 (520); and provides he outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
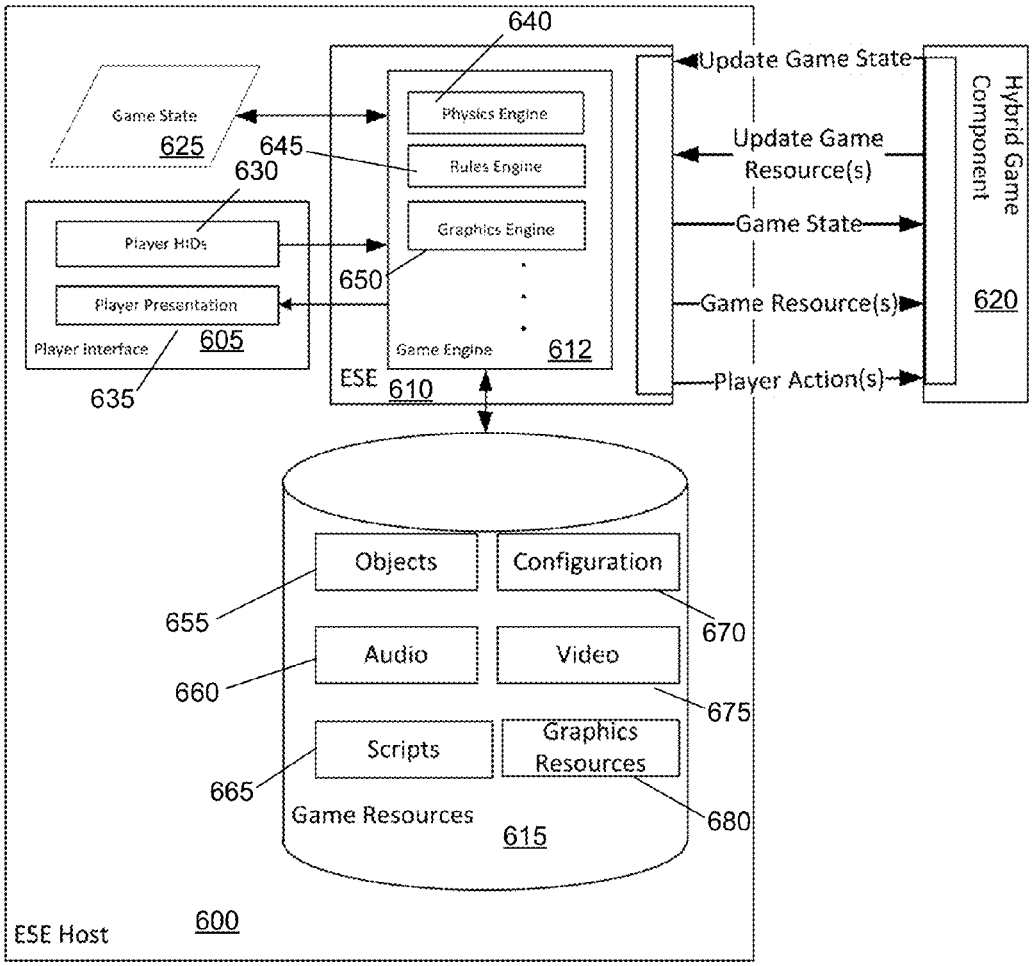
FIG. 6 illustrates a conceptual diagram of aspects of an Entertainment System Engine in accordance with embodiments of the invention.

A block diagram of components an ESE being provided by an ESE host for a gambling hybrid game in accordance with embodiments of the invention are shown in FIG. 6. An ESE 610 may be part of the entertainment game itself, may be a software module that is executed by the entertainment game, or may provide an execution environment for the entertainment game for a particular host. The ESE 610 and associated entertainment game are hosted by an ESE host 600. The ESE host 600 is a computing device that is capable of hosting the ESE 610 and the entertainment game. Exemplary hosts include video game consoles, smart phones, personal computers, tablet computers, or the like. The entertainment game includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment game. Various components or sub-engines of the game engine read data from a game state in order to implement the features of the game. Components of the game engine include a physics engine 640 used to simulate physical interactions between virtual objects in the game state, a rules engine 645 for implementing the rules of the game, an RNG that may be used for influencing or determining certain variables and/or outcomes to provide a randomizing influence on game play, a graphics engine 650 used to generate a visual representation of the game state to the player, an audio engine to generate audio outputs for the player interface, and any other engine needed to provide the entertainment game. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment game. The game resources 615 may also include audio files 660 used to generate music, sound effects, etc. within the entertainment game. The game resources 615 may also include configuration files 670 used to configure the features of the entertainment game. The game resources 615 may also include scripts 665 or other types of control code used to implement various game play features of the entertainment game. The game resources 615 may also include graphics resources 680 including, but not limited to, textures, and objects that are used by the game engine to render objects displayed in the entertainment game.

In operation, components of the game engine 612 read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process loops in a game loop continuously while the player plays the game.

The ESE 610 provides one or more interfaces between an entertainment game and other components 620 of a gambling hybrid game, such as a GWE. The ESE 610 and the other gambling hybrid game component 620 communicate with each other using the interfaces, such as by passing various types of data and sending and receiving messages, status information, commands and the like. Examples of communications include, but are not limited to, requesting by the gambling hybrid game component 620 that the ESE 610 update the game state using information provided by the other component; requesting, by the gambling hybrid game component 620, that the ESE 610 update one or more game resources using information provided by the gambling hybrid game component 620; the ESE 610 providing all or a portion of the game state; the ESE 610 providing one or more of the game resources to the gambling hybrid game component 620; and the ESE 610 communicating player actions to the other gambling hybrid game component 620. The player actions may be low level player interactions with the player interface, such as manipulation of an HID, or may be high level interactions with objects as determined by the entertainment game. The player actions may also include resultant actions such as modifications to the game state or game resources resulting from the player's actions taken in the game. Other examples of player actions include actions taken by entities, such as Non-Player Characters (NPC) of the entertainment game, that act on behalf of, or under the control of, the player.

Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world credits, experience points, or points generally. Wagers can be made in the gambling game as triggered by the player's use of one or more elements of the entertainment game. The wagers are made using real world credits (RC). The real world credits can be credits in an actual currency, or can be credits in a virtual currency which may have a real world value. Gambling outcomes from the gambling game can cause consumption, loss or accrual of RC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RC value if cashed out of a gameplay session.

Example elements include enabling elements (EE) which are elements that enable a player's play of the entertainment game and whose consumption by the player while playing the entertainment game can trigger a wager in a gambling game. Another non limiting example of an element is a reserve enabling element (REE), which is an element that converts into one or more enabling elements upon occurrence of a release event in skill wagering interleaved game gameplay. Other types of elements include actionable elements (AE) which are elements that are acted upon to trigger a wager in the gambling game and may or may not be restorable during normal play of the entertainment game. Another type of element is a common enabling element (CEE) which as an element that may be shared by two or more players and the use of which by any of the players causes a wager to be triggered.

In progressing through entertainment game gameplay, elements can be utilized by a player during interactions with a controlled entity (CE) which is a character, entity, inanimate object, device or other object under control of a player.

Also, entertainment game gameplay progress and wager triggers can be dependent upon a game world variable such as, but not limited to: a required game object (RGO) which is a specific game object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RC and elements as discussed above, any gameplay resource can be utilized to advance gameplay as well as form the basis for a trigger of a wager as appropriate to the specification of a specific application in accordance with various embodiments of the invention. Various hybrid games are discussed in PCT Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety.

Figure 7:
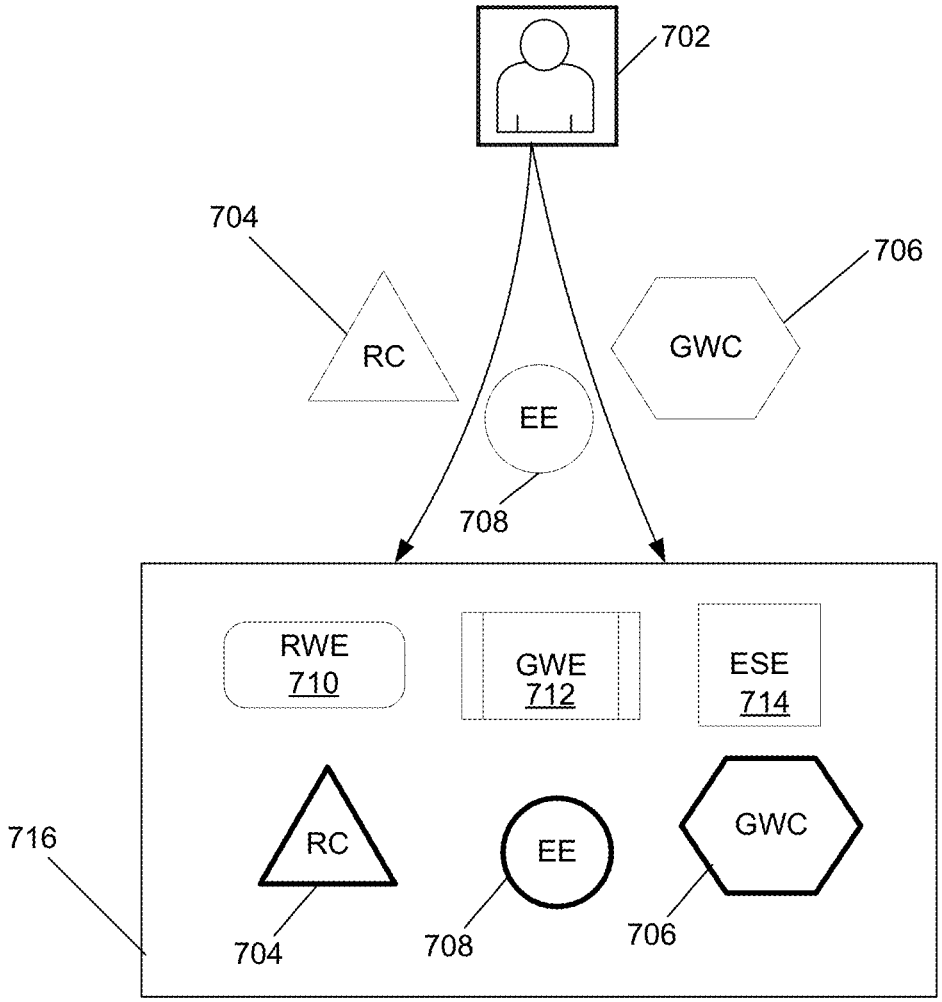
FIG. 7 illustrates a conceptual diagram of interactions between a user and a gambling hybrid game in accordance with embodiments of the invention.

In accordance with some embodiments, a player can interact with a gambling hybrid game by using RC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RC and elements, such as but not limited to enabling elements (EE), are utilized in a gambling hybrid game in accordance with an embodiment of the invention is illustrated in FIG. 7. The conceptual diagram illustrates that RC 704, EE 708 and GWC 706 can be utilized by a player 702 in interactions with the RWE 710, GWE 712 and ESE 714 of a based gambling hybrid game 716. The contribution of elements, such as EE 708, can be linked to a player's access to credits, such as RC 704 or GWC 706. Electronic receipt of these credits can come via a smart card, voucher or other portable media, or as received over a network from a server. In accordance with certain embodiments, these credits can be drawn on demand from a player profile located in a database locally on a gambling hybrid game or in a remote server.

Figure 8:
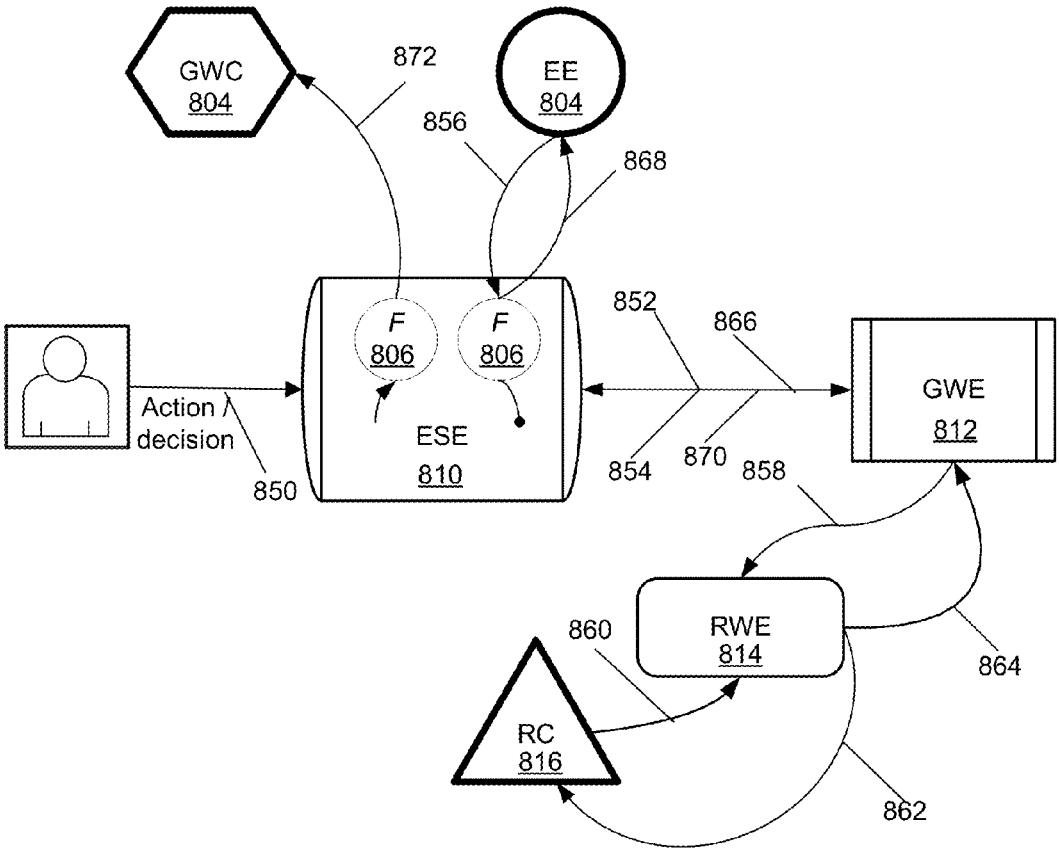
FIG. 8 illustrates a conceptual diagram that illustrates the interplay between aspects of a gambling hybrid game in accordance with some embodiments of the invention using Real World Currency (RC).

A conceptual diagram that illustrates the interplay between aspects of a gambling hybrid game in accordance with an embodiment of the invention using real world credit (RC) is illustrated in FIG. 8. Similar to FIG. 7, a player's actions and/or decisions can affect functions 806 that consume and/or accumulate GWC 802 and/or EE 804 in an entertainment game executed by an ESE 810. A GWE 812 can monitor the activities taking place within an entertainment game executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the gambling hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment game (866). Function 806 of the ESE 810 performs the adjustment of EE 804 (868). The ESE 810 signals the GWE 812 as to the updated status (870). In response, the GWE 812 signals the ESE 810 to update GWC of the entertainment game. The ESE updates the GWC 802 using a function 806 (872).

The following is an example of the above flow in a first person shooter game, such a Call of Duty®, using a gambling hybrid game sequence in accordance with embodiments of the invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during game play. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in a gambling hybrid game, but is not intended to be exhaustive and only lists only one of numerous possibilities of how a gambling hybrid game may be configured to manage its fundamental credits.

Figure 9:
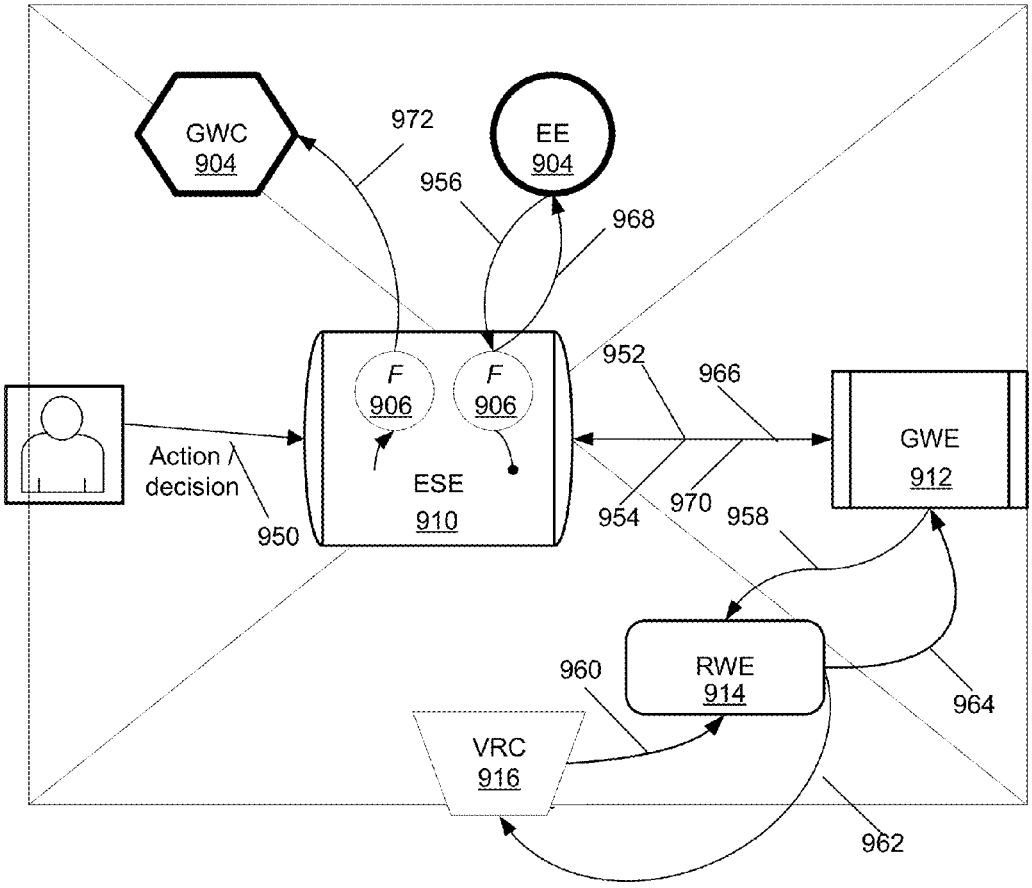
FIG. 9 illustrates a conceptual diagram that illustrates the interplay between aspects of a gambling hybrid game in accordance with other embodiments of the invention using Virtual Real World Currency (VRC).

A conceptual diagram that illustrates the interplay between aspects of a gambling hybrid game in accordance with an embodiment of the invention using virtual real world credit (VRC) is illustrated in FIG. 9. As seen in the FIG. 9, substituting VRC in place of RC is effected without impact to the architecture or operation of the gambling hybrid game. The implementation of FIG. 9 is not the only embodiment using virtual currency within a gambling hybrid game, but shows only one permutation of which many could exist.

Similar to FIG. 8, a player's actions and/or decisions can affect functions 906 that consume and/or accumulate GWC 902 and/or EE 904 in an entertainment game executed by an ESE 910 in the process shown in FIG. 9. A GWE 912 can monitor the activities taking place within an entertainment game executed by an ESE 910 for gameplay gambling event occurrences. The GWE 912 can also communicate the gameplay gambling event occurrences to a RWE 914. Unlike the process shown in FIG. 8, RWE 914 triggers a wager of virtual real world credit (VRC) 916 in a gambling game executed by the RWE 914.

For purposes of this discussion, VRC can be thought of as a form of alternate currency, which can be acquired, purchased or transferred, in unit or in bulk, by/to a player, but does not necessarily directly correlate to RC or real currency. As an example, there is a virtual currency called "Triax Jacks", 1000 units of which are given to a player by an operator of a gambling hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the gambling hybrid game that Triax Jacks would be wagered in place of RC, such that the gambling hybrid game could be played for free, or with played with operator sponsored Triax Jacks.

Returning to the process in FIG. 9, the following may occur during use of the gambling hybrid game in accordance with embodiments of the invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment game (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment game. The ESE updates the GWC 902 using a function 906 (972).

Network Based Gambling Hybrid Game

Figure 10:
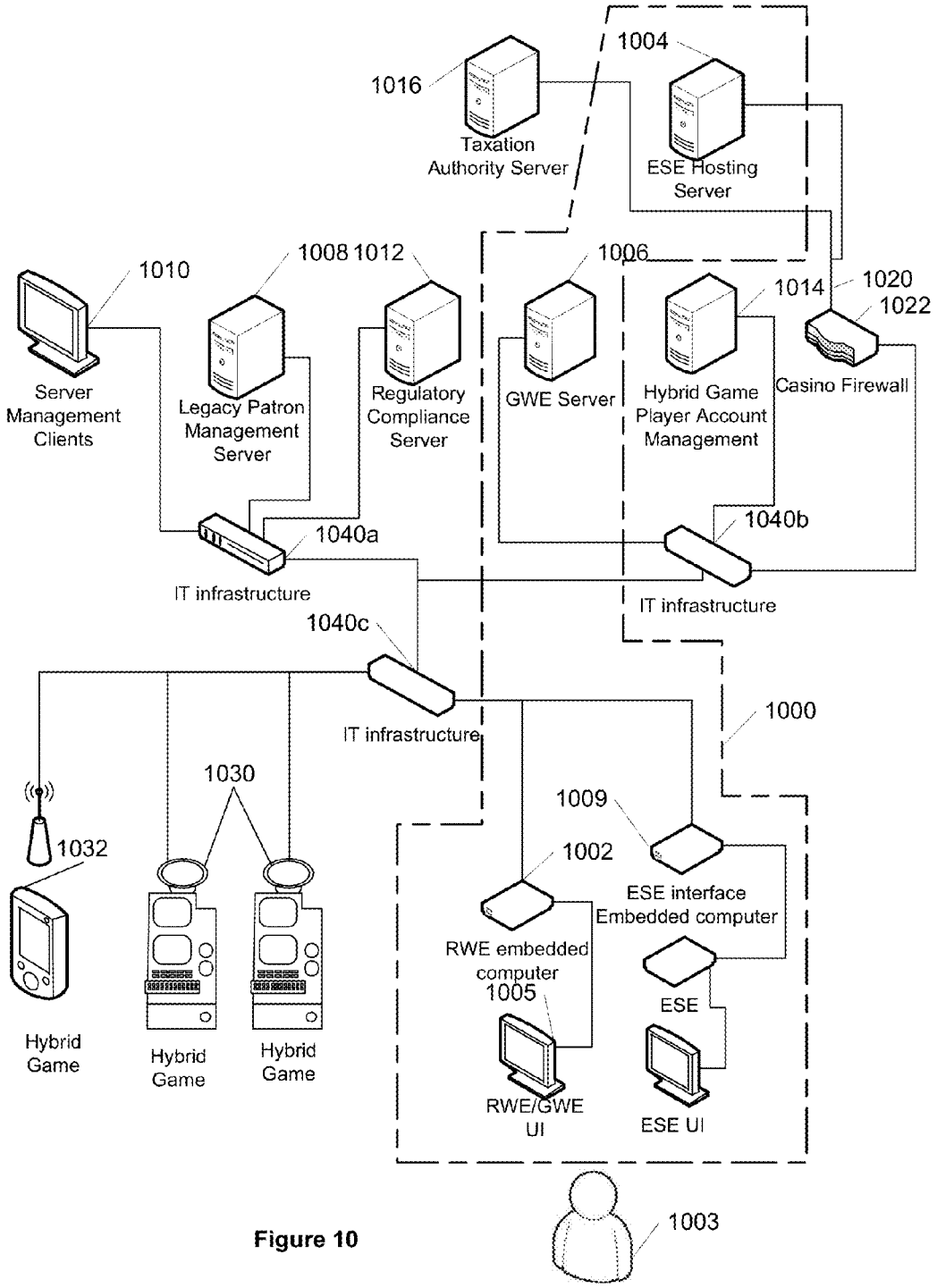
FIG. 10 illustrates a system diagram of an implementation of a network based gambling hybrid game in accordance with another embodiment of the invention.

A system diagram that illustrates an implementation of a network distributed gambling hybrid game with a GWE local server in accordance with embodiments of the invention is illustrated in FIG. 10. In the figure, the gambling hybrid game 1000 includes components, RWE 1002 embedded in a device used as the user interface for player 1003. The device provides both a RWE/GWE user interface 1005 and an ESE user interface 1007 for the player. The ESE is provisioned by an ESE hosting server 1004 via ESE interface 1009, and the GWE is provisioned by GWE server 1006 as indicated by the dashed line. Also pictured in the diagram are a number of other peripheral systems, such as player management 1008, casino management 1010, regulatory 1012, hybrid game player account management 1014, and taxation authority 1016 hosting servers that may be present in such an implementation. FIG. 10 also illustrates various other systems, which may reside outside the bounds of the casino and are connected to the framework via communications network, such as the Internet 1020, depicted by the connection lines past the casino firewall 1022. The end devices utilized for user interfaces for a gambling hybrid game include, but are not limited to, casino electronic game machines 1030 and wireless or portable devices, such as smart phone 1032, personal digital assistants, tablet computers, video gaming consoles or the like. These disparate devices are connected within and without the casino through the casino's information technology structure as illustrated by routers 1040*a*, 1040*b* and 1040*c*. It should be understood that FIG. 10 does not attempt to illustrate all servers and systems to which a gambling hybrid game 1000 might be inevitably be connected, and indeed one might expect there would be others, but rather provides an example of a set of a sub-set of systems which would be present in an exemplary embodiment of an installation.

Figure 11:
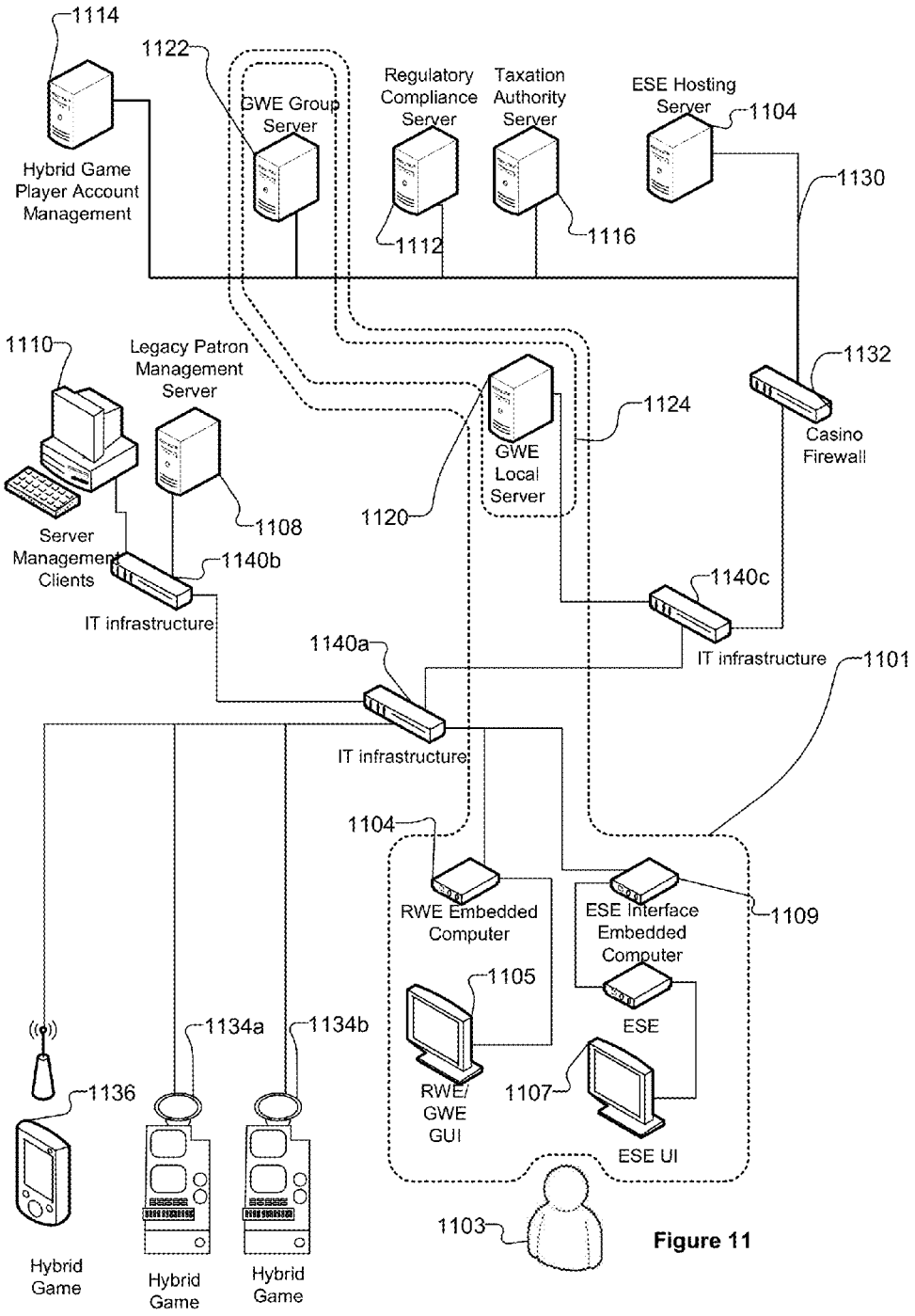
FIG. 11 illustrates a system diagram of an implementation of an Internet based gambling hybrid game in accordance with an embodiment of the invention.

FIG. 11 is a diagram showing another implementation of a gambling hybrid game in accordance with an exemplary embodiment. In the figure, the gambling hybrid game 1101 includes components, RWE 1104 embedded in a device used as the user interface for player 1103. The device provides both a RWE/GWE user interface 1105 and an ESE user interface 1007 for the player. The ESE is provisioned by an ESE hosting server 1104 via ESE interface 1109. Also pictured in the diagram are a number of other peripheral systems, such as player management 1108, casino management 1110, regulatory 1112, hybrid game player account management 1114, and taxation authority 1116 hosting servers that may be present in such an implementation. In the figure, note that the GWE is composed of two sub-components, a local GWE server 1120, and a cloud server 1122. (components within the dash line area 1124). In the figure, certain of the components are located within the bounds of the casino, namely the RWE, the ESE and a portion of the GWE, namely the local GWE server 1120. The Cloud Server GWE 1122 is located in the cloud connected to the casino bounded gambling hybrid game components via communications network such as the Internet 1130 through a firewall 1132. FIG. 11 also illustrates various other systems, which may reside outside the bounds of the casino and are connected to the framework via communications network. The end devices utilized for user interfaces for a gambling hybrid game include, but are not limited to, casino electronic game machines, 1134*a* and 1134*b*, and wireless or portable devices, such as smart phone 1136, personal digital assistants, tablet computers, video gaming consoles or the like. These disparate devices are connected within and without the casino through the casino's information technology structure as illustrated by routers 1140*a*, 1140*b* and 1140*c*. It should be understood that FIG. 11 does not attempt to illustrate all servers and systems to which a gambling hybrid game might be inevitably be connected, and indeed one might expect there would be others, but rather provides an example of a set of a sub-set of systems which would be present in an exemplary embodiment of an installation.

Figure 12:
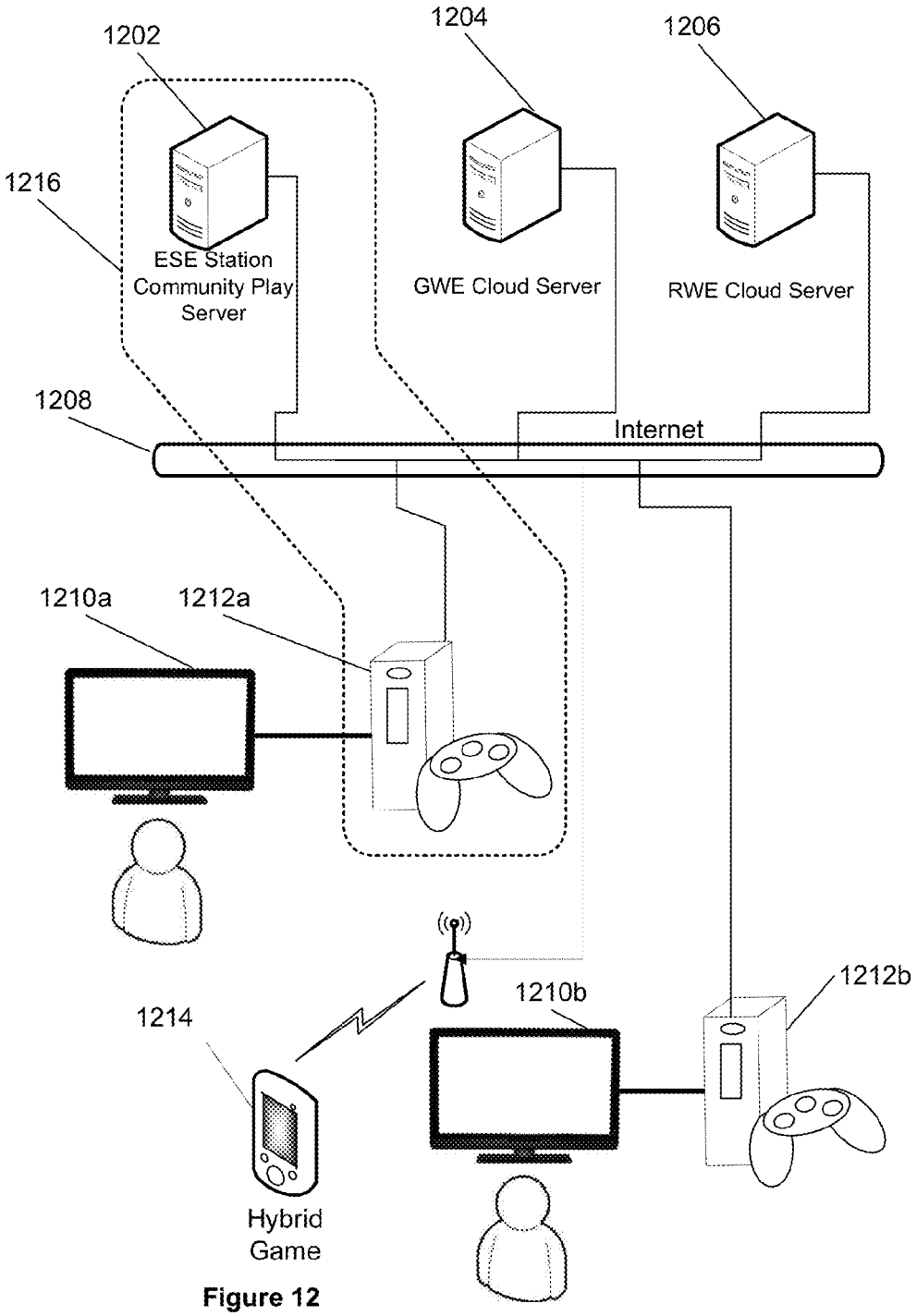
FIG. 12 illustrates a system diagram of an implementation of a cloud based gambling hybrid game in accordance with embodiments of the invention.

A system diagram that illustrates an implementation of network a cloud based gambling hybrid game over the Internet in accordance with an embodiment of the invention is illustrated in FIG. 12. The system includes an ESE server 1202, GWE server 1204 and RWE server 1206 that each connect to a user interface, 1210*a* or 1210*b*, (such as, but not limited to, a television screen, computer terminal, tablet, touchscreen or PDA) of gambling hybrid games over the Internet 1208. Each gambling hybrid game includes a local ESE 1212*a* or 1212*b* (such as, but not limited to, a video game console or a gaming computer system) that interfaces with a remote ESE server 1002. Processes performed by an ESE 1212*a* services can be performed in multiple locations, such as, but not limited to, remotely on an ESE server 1202 and locally on a local ESE 1212*a*. In addition, a gambling hybrid game may include a Personal Digital Assistant (PDA) 1214 or other type of mobile computing device game coupled to the ESE hosting server 1202, thus providing the opportunity for a player to play a gambling hybrid game on the PDA through a mobile phone or data network.

There are many possible permutations of how a gambling hybrid game could be constructed, with FIGS. 10, 11 and 12 showing only three possible permutations and provided as examples, which are not intended to suggest limitations to the forms of the architecture. Other embodiments include a version where the entire gambling hybrid game is in the cloud with only a client running on player terminal within the bounds of the casino, or a version where the RWE and GWE are casino bound and the ESE exists in the cloud, accessed by a client running on a terminal in the casino.

Processing Apparatuses

Figure 13:
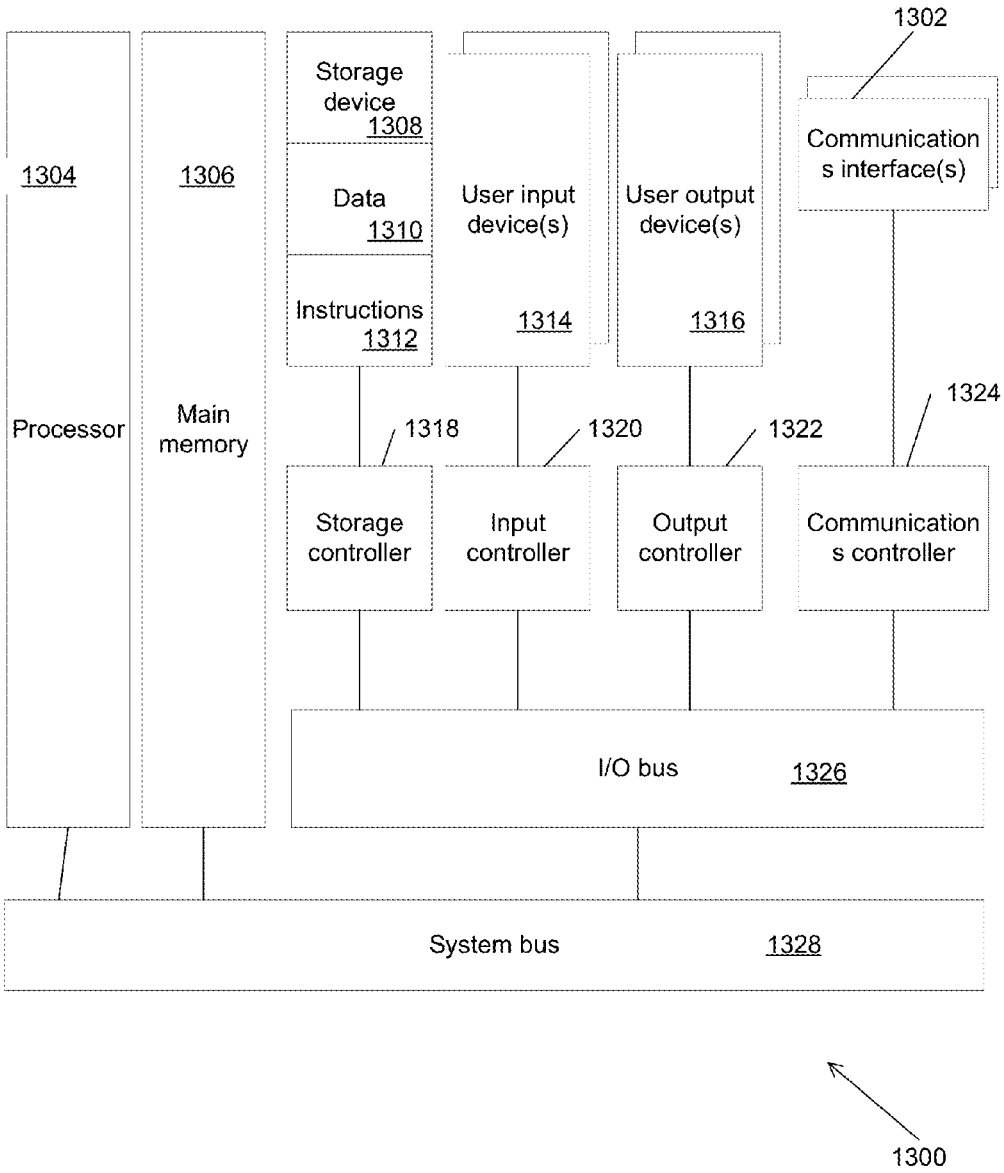
FIG. 13 illustrates a block diagram of components of a device implementing a gambling hybrid game in accordance with an embodiment of the invention.

Any of a variety of processing apparatuses can host various components of a gambling hybrid game in accordance with embodiments of the invention. In accordance with embodiments of the invention, these processing apparatuses can include, but are not limited to, mobile device such as a smartphone, personal digital assistant or the like, a wireless device such as a tablet computer or the like, an electronic gaming machine, a general purpose computer, a computing device and/or a controller. A processing apparatus that is constructed to implement a gambling hybrid game in accordance with embodiments of the invention is illustrated in FIG. 13. In the processing apparatus 1300, a processor 1304 is coupled to a memory 1306 by a bus 1328. The processor 1304 is also coupled to non-transitory processor-readable storage media, such as a storage device 1308 that stores processor-executable instructions 1312 and data 1310 through the system bus 1328 to an I/O bus 1326 through a storage controller 1318. The processor 1304 is also coupled to one or more interfaces that can be used to connect the processor to other processing apparatuses as well as networks as described herein. The processor 1304 is also coupled via the bus to user input devices 1314, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1304 is coupled to tactile output devices like vibrators, and/or manipulators. The processor 1304 is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In accordance with various embodiments, a processor 1304 can load instructions and data from the storage device into the memory 1306. The processor 1304 can also execute instructions that operate on the data to implement various aspects and features of the components of a gambling hybrid game. The processor 1304 can utilize various input and output devices in accordance with the instructions and the data in order to create and operate user interfaces for players or operators of a gambling hybrid game (such as but not limited to a casino that hosts the gambling hybrid game).

Although the processing apparatus 1300 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 1304 through one of the interfaces or over a network. Furthermore, any of the user input devices or user output devices can be coupled to the processor 1304 via one of the interfaces or over a network. In addition, although a single processor 1304 is described, those skilled in the art will understand that the processor 1304 can be a controller or other computing device or a separate computer as well as be composed of multiple processors or computing devices including one or more processors.

Player Interaction with a Gambling Hybrid Game

Figure 14:
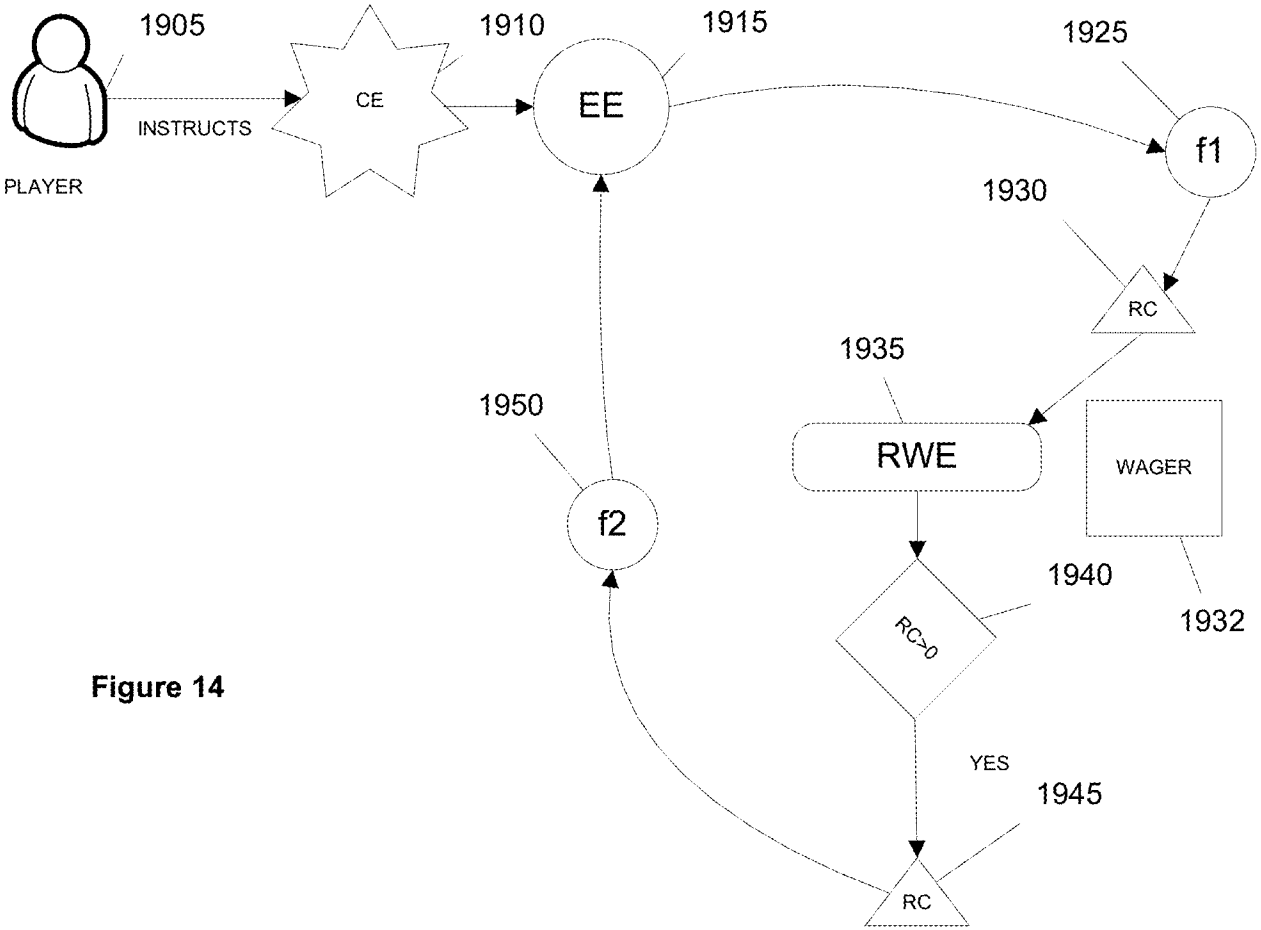
FIG. 14 illustrates a conceptual diagram of a single player interacting with a gambling hybrid game in accordance with embodiments of the invention.

In accordance with many embodiments of the invention, a gambling hybrid game allows a player to make wagers on propositions of a gambling event that occurs during play of an entertainment game. A conceptual diagram of operation of a gambling hybrid game interacting with a single player and providing a gambling event in accordance with embodiments of the invention is shown in FIG. 14. In FIG. 14, a player 1905 enters an input directing a controllable element 1910 in an entertainment game. In response to the player's input, the controllable element interacts with an element, such as enabling element (EE) 1915, of the entertainment game. Interaction with the element as determined by the player's input determines the appropriate update to the status of the entertainment game based upon the input. The updated status of the entertainment game is provided to a function 1925, f1 that determines whether the updated status triggers a gambling event. A gambling event is an event that includes probabilities that a certain outcome will result. A proposition of a gambling event is a wager 1932 or bet that a certain outcome will occur. The gambling event includes the wager 1932 of real world credits (RC) 1930. The wager may be input by the user or be based upon the gambling event occurring. The RWE 1935 is informed of the gambling event and determines the outcome 1945 of the gambling event and the wager (1940). The outcome of the gambling event is provided to a function 1950 f2. The f2 1950 incorporates the results into game play parameters and provides the game play parameters to EE 1915 for incorporation into the entertainment game. Other aspects and embodiments disclosed previously are incorporated by reference herein. For the purposes of this disclosure, this construct will represent the base case of a player that is engaged in single-player play against himself, time, a computer opponent, etc.

The result of a gambling event may affect the entertainment game in accordance with some embodiments of the invention. The effect of the result of the gambling event may be impacted by the amount of RC that a player wagers on a proposition about the gambling event. One manner that may be used to determine the effects of the gambling result on the entertainment gamer is to provide an intermediate value holder, herein referred to as a quanta, determined by the result of the gambling event, which may be then used in the entertainment game to change parameters of the game to reflect the results of the gambling event. A conceptual diagram of a player interacting with a gambling hybrid game that provides quanta as a result of a gambling event and uses the quanta to affect the entertainment game is shown in FIG. 15.

Figure 15:
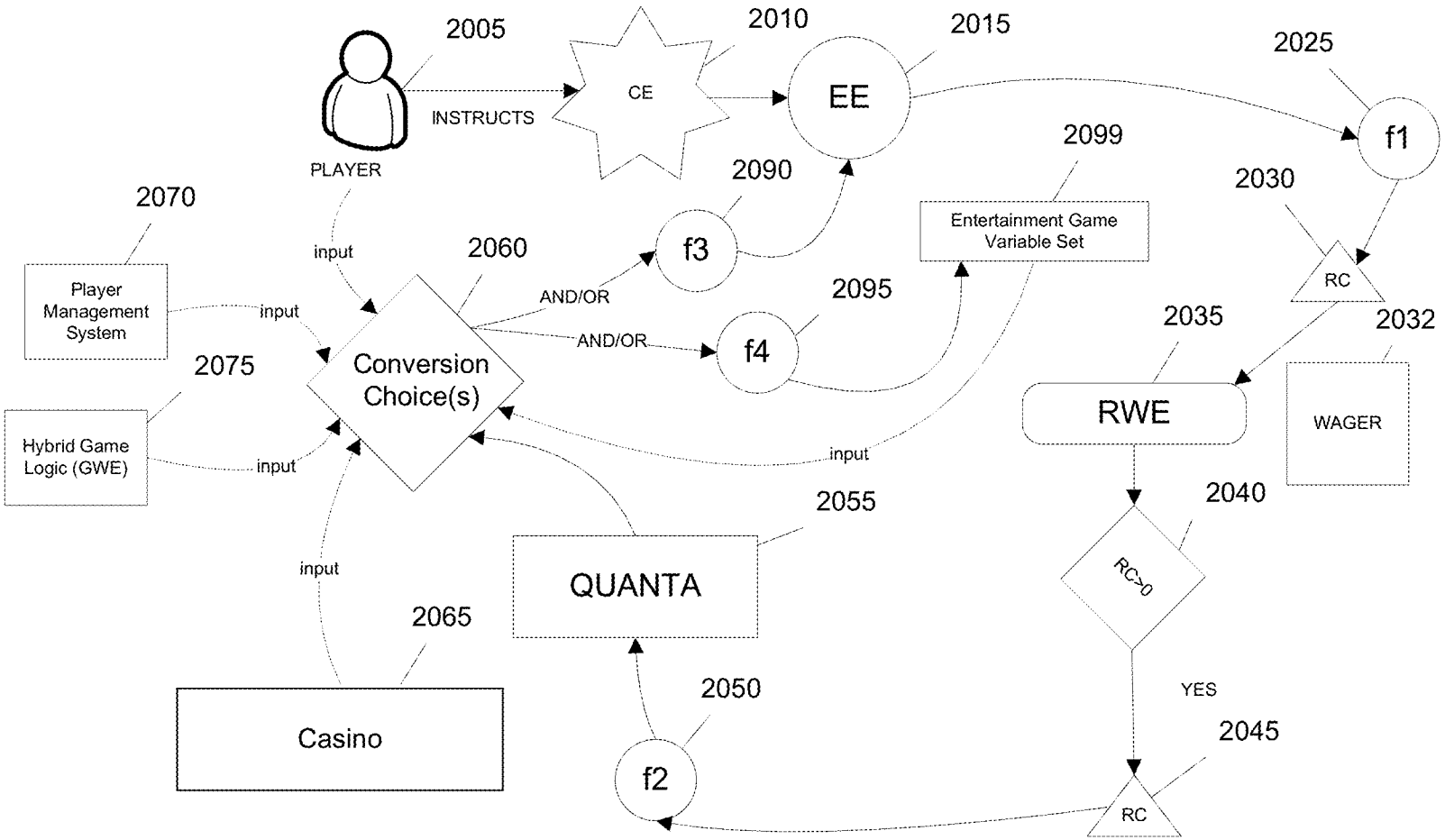
FIG. 15 illustrates a conceptual diagram of a single player interacting with a gambling hybrid game that includes a process for providing quanta credits in accordance with embodiments of the invention.

In FIG. 15, a player 2005 enters an input directing a controllable element 2010 in an entertainment game to interact with an entertainment game element, such as but not limited to (EE) 2015, receives the input and determines the appropriate update to the status of the entertainment game based upon the input. The updated status of the entertainment game is provided to a function 2025, f1 that determines whether the updated status triggers a gambling event. A gambling event is an event that includes probabilities that a certain outcome will result. A proposition of a gambling event is a bet that a certain outcome will occur. A wager then is an amount based on a payout of the proposition as to whether or not the outcome will occur. The gambling event includes a wager 2032 of real world credits (RC or RC) 2030. The wager may be input by the user or be based upon the gambling event occurring. The RWE 2035 is informed of the gambling event and determines the outcome 2045 of the gambling event and the wager (2040). The outcome of the gambling event is provided to a function 2050, f2. The f2 2050 converts the result of the gambling event 2045 into an intermediate value holder or quanta 2055.

Quanta, which may or may not be observable to the player as part of the play of the gambling hybrid game, is ultimately converted into one or more elements including, but not limited to, EE, AE, CEE, in-game objects, in-game currency, CEC, REC, and CE attributes in use within the entertainment game portion of the gambling hybrid game. In accordance with some embodiments, the quanta can either partly or entirely, be converted into a form of currency including, but not limited to, RC, GWC, and UGWC.

Referring back to FIG. 15, quanta 2055 is provided to one or more processes, functions f3 2090 and f4 2095 performed by the GWE or EE (2060). F3 2090 provides the quanta to the EE 2015 to allow the EE to provide the amount of quanta gained from the gambling event to be provided to the user and f4 2095 converts the quanta into changes in a set of entertainment game variables 2099. Functions f3 2090 and f4 2095 convert the quanta 2055 into one or more of downstream elements as a function of one or more of the drivers. The drivers may include, but are not limited to a player management system 2070; a gambling hybrid game logic 2075 such as the GWE; and/or a provider management system represented by casino system 2065. The algorithm by which the quanta 2055 is converted to another form may be established at the onset of game play, in real time during game play, or at other times as dictated by the gambling hybrid game. The algorithm may also be a function of inputs from other sources including, but not limited to, conversion choices by the player; casino choices (which may be temporal or permanent in nature or a combination thereof); variables within the entertainment game; variables within the player profile; GWE software (hybrid game Logic)—which may or may not also take into account the entertainment game state; and/or other variables.

In accordance with some embodiments, f3 2090 and f4 2095 may be replaced by multiple functions or processes. Each function represents a variable or element into which quanta can be converted, or a more integrated function that distributes the quanta such that f3 2090 and f4 2095 are replaced by a lesser number of more substantive functions of greater expanse. One skilled in the art will also note that the conversion of Quanta into a specific element or variable can be: (a) affected at any time at the behest of a player and/or casino and/or the hybrid game logic itself as resident within the GWE; and/or (b) at specific times as dictated by game play entertainment, gambling hybrid game logic, casino control, regulatory restrictions/rules, or other inputs. Thus, the conversion of quanta may be "latched" in that the conversion may only be undertaken at certain times or points in the play of the entertainment game.

The game world engine (GWE) may include functionality by which quanta are conserved across more than one game session, or Quanta can only persist within a single game session. Quanta, like GWC in this regard, can also be subject to exchange across various games and/or domains. Alternately, a universal quanta can be deployed, or a standardized quanta system that is analogous to a Standardized System Score (SSS) for GWC standardization across multiple game platforms can be deployed to make Quanta fungible across multiple game platforms and/or domains (e.g. casino property groups).

The following are examples of gambling hybrid games in which quanta are earned during a gambling event and may be used to affect the game play of the entertainment game.

The first example is a shooter game in which the quanta are labeled as "Depot Points" and a numerical value assigned to the amount. When a player fires bullets (EE), RC is committed to a gambling event in the RWE. In the event of a gambling event win, RC accrues to the player, and, via f2, Quanta is accumulated. In this example, the quanta is labeled "Depot Points" and a numerical value assigned to the amount. As the player plays the game, she accumulates depot points in the Depot. Depot points can be converted into one of the following: bullets, advanced weapons, health points, and the ability to revive your player when killed.

Each of these conversions is associated with a specific amount of Depot Points (i.e. quanta). The following are examples of the conversion of the depot points into entertainment game variables: a clip of 10 bullets may be obtained 10 depot points, an improved accuracy rifle may be obtained for 35 depot points, a machine gun may be obtained for 80 depot points, and the ability to revive your player when killed may require 250 depot points.

The availability of various conversions can be indicated to the player graphically via the conversion, for example, of an icon representing each potential conversion from "greyed out" to "full color" when the amount of Depot Points available exceeds that required for the conversion. In this example, conversion of depot points to bullets takes place automatically if the player expends all their bullets. All other conversions require manual intervention by the player. Such intervention can take place when check-points are reached, or the player can do it during real-time game play by entering a "depot" in the game space. In other versions, the player can pause the game at any time and affect conversions of "depot points" into additional EE or other game variables.

The act of pausing the game may also cause some amount of depot points to be consumed.

In another shooter game example, Quanta is only converted into bullets, and this takes place automatically and continuously throughout the game. No player selection is afforded.

A second example of the use of quanta to affect an entertainment game in a gambling hybrid game is a gambling hybrid game that includes a racing game. In a racing game, a gambling event is initiated each time a gallon of fuel (EE) is consumed by the race car. If the gambling event returns a net gain in RC, an amount of Quanta is accrued to the player as a function of f2. The amount of Quanta is conveyed to the player as "pit points". The pit points may be provided to a player account and carry over from one race to another. In this particular example, The player is able to convert "pit points" into one of the following when he brings his car into the pit during the race: standard fuel; high performance fuel (this fuel also causes additional RC to be committed to gambling games as it is consumed relative to standard fuel); new tires; and various repairs to damage he may have accumulated during the car's time on the track. The player is also able to convert "pit points" into the following in-between races: improved engines (multiple choices—more fuel efficient, more reliable, faster, etc.); improved suspensions; better maneuverability; and improved aerodynamics (or body styles). In this example racing game, the pit points are not automatically converted to fuel when the player brings his car into the pit. The player must manually fill the tank via a "drag and drop" or other type of selection system that reflects what the player can afford given the available "pit points".

A third example of a gambling hybrid game providing and using quanta is a Battleship type game. In this example game, a gambling event is initiated each time a "peg" (EE) is placed on the board. If the gambling event returns a net gain in RC, an amount of Quanta is accrued to the player as a function of f2. The amount of Quanta is conveyed to the player as "arsenal funds". The player is able to convert "arsenal funds" into one of the following at the onset of each of her turns in the game: a standard "peg", a peg that "hits" a 2×2 array in lieu of a single location, the ability to move one of her ships, the ability to cloak a ship for three turns, and a "spy plane" peg that gives the player visibility of a 4×4 array on the opponents board for one turn. In this example, the use of the "spy plane" peg may also initiate a RNG that determines whether the opponent becomes aware that a spy plane peg was used or not. Each of the aforementioned, when used, constitutes a type of EE, and has associated with it a specific amount of RC that will be committed to a gambling game. In this game example, arsenal funds do not persist past the close of the specific game in question.

A fourth example of a gambling hybrid game that provides and uses quanta is a gambling hybrid game that includes an entertainment game of Happy Letters. There are multiple types of gameplay available through Happy Letters. In the first iteration, a gambling event is initiated each time a tile (EE) is placed on the board. If the gambling event returns a net gain in RC, an amount of Quanta is accrued to the player as a function of f2. The amount of Quanta is conveyed to the player as "happy points". The player is able to convert "happy points" into one of the following, at the onset of each of her turns during play: an extra draw of a letter; a marker that makes a square on the board a "bonus" square, (triple letter, double word, etc.); a blank tile; a specific letter tile; a hint for the "best play" available; and a free tile redraw during which a player may redraw any number or all of their tiles from the tile pool without losing their turn. The different options that may become available to a player during gameplay may be "greyed out" at the start of gameplay. As quanta is accrued, different options may become visible, and a player may select those options. It is possible that in spite of RC wins, a player may not accrue enough quanta to purchase one, or any of the options during a particular turn.

In a second iteration of the Happy Letters gambling hybrid game, the gambling event is initiated each time a tile is pulled from the pool of tiles (AE). If the gambling event returns a net gain in RC, an amount of quanta is accrued to the player as a function of f2. The amount of quanta is conveyed to the player as "happy points". The options available and overall quanta costs may remain the same as the first iteration described above. However, the happy points may be awarded at different points in gameplay depending on the mechanics used.

A fifth example of a gambling hybrid game in which quanta are provided and used is a sports game. The particular sports game in this example is ice hockey. In an ice hockey gambling hybrid game, a gambling event may be initiated by a specific amount of time passing in the game, a player shooting the puck, or as a function of the distance skated. If the gambling event returns a net gain in RC, an amount of quanta is accrued to the player as a function of f2. The amount of Quanta is conveyed to the player as "draft points". The player is able to convert "draft points" into one of the following at the onset or a stoppage of play during a game: increased game time, time outs, better equipment, additional energy, free shots, and new plays. The player is also able to convert "draft points" into the following in-between games: additional players and better equipment. In these instances, the players/equipment available and/or funds available to purchase the players/equipment may be effected by the use of quanta.

A sixth example is of a gambling hybrid game that provides and uses quanta is a gambling hybrid game that provides Sudoku as an entertainment game. Sudoku is a puzzle game that is often played on a timed basis. In the gambling hybrid game, a gambling event is initiated each time a "number" (EE) is placed or removed from the board. If the gambling event returns a net gain in RC, an amount of quanta is accrued to the player as a function of f2. The amount of quanta is conveyed to the player as "puzzle points". The player is able to convert "puzzle points" into one of the following at the onset of each turn in the game: augment the amount of game time available to complete the puzzle; access to hints or cheats where the hints can be explicit such as, "The top left box is filled with the number 8" or less direct such as, "The top left box is filled with an odd number"; and "number check" in which an incorrectly placed number is highlighted for the player. Each of the aforementioned, when used, constitutes a type of EE, and has a specific amount of RC that is associated with the selection that will be committed to a gambling game. In some gambling hybrid games, Sudoku may also be played as a team game. In team play, players pool their funds and EE mechanisms are shifted to a CEE paradigm. The aforementioned ideas all apply in this context; however teams may be able to pool quanta in order to purchase specific options.

A seventh example of a gambling hybrid game that provides and uses quanta is a gambling hybrid game that provides boxing as an entertainment game. When a player attempts to punch their opponent (AE), RC is committed to a gambling event in the RWE. If the result of the gambling event is a win, RC accrues to the player, and, via f2, Quanta is accumulated. The amount of quanta is conveyed to the player as "water bottles" in a cooler. As the boxing match continues, the player accumulates water bottles in the cooler. The water bottles can be converted into one of the following: additional damage when punching, advanced combination moves, health points, and the ability to revive your player when knocked out. Each of these conversions is associated with a specific amount of water bottles (i.e. quanta). For example, an increase of 3 health points may "cost" 1 water bottle, a special right-cross uppercut combo may "cost" 5 water bottles, and a knock out recovery may "cost" 12 water bottles. Quanta conversions may occur between rounds or during real-time gameplay by clicking on the appropriate icon, for instance making the next AE modified by the increased damage when punching option. In other versions of the boxing gambling hybrid game, the player can pause the game at any time and affect conversions of "water bottles" into additional health points or other game variables. The act of pausing the game may also cause some amount of water bottles to be consumed. In another of a boxing gambling hybrid game, quanta is only converted into health points, and this takes place automatically and continuously throughout the game. No player selection is afforded.

An eighth example of a gambling hybrid game that provides and uses quanta is a gambling hybrid game that provides Tic-Tac-Toe as an entertainment game. Tic-Tac-Toe is a puzzle game that may be modified in a variety of ways. This may include a larger board than the traditional 3×3 grid, 3d space, and markers that may be overridden by other markers. A gambling event is initiated each time a "marker" (EE) is placed or removed from the board. If the gambling event returns a net gain in RC, an amount of quanta is accrued to the player as a function of f2. The amount of Quanta is conveyed to the player as "puzzle points". The player is able to convert "puzzle points" into one of the following at the onset of each of her turns in the game: augment the number of markers available; has access to hints or cheats where the hints may be explicit such as, "The top left box is filled with the number 8" or less direct such as, "The top left box is filled with an odd number"; and larger markers that can override underlying markers. In some variants of the gambling hybrid game Tic-Tac-Toe game, each player has access to a set number of different sized markers. For instance, a player may have 2 large X's, 2 Medium X's and 2 Small X's. Quanta may give access to more of these markers. In some other variants, quanta may give access to a "Super Large" marker that would otherwise be unavailable to the player. This "Super Large" marker may override any other marker on the board.

Systems and Process for Proving Quanta

Figure 16:
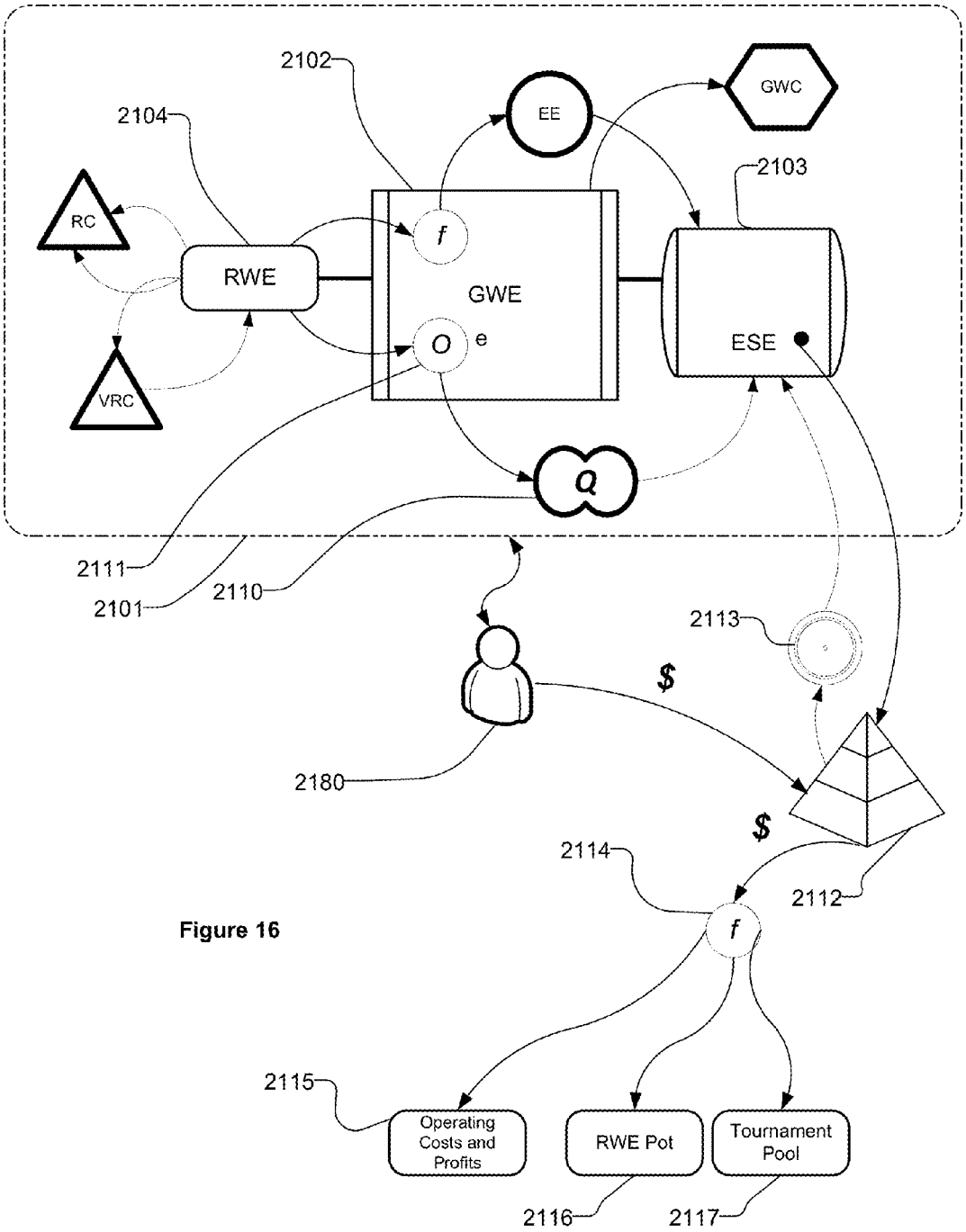
FIG. 16 illustrates a conceptual diagram of a player interacting with a gambling hybrid games to obtain and use quanta credits in accordance with embodiments of the invention.

A conceptual diagram of process flow, functional exchanges and interactions between components of a gambling hybrid game system to obtain and use quanta in accordance with embodiments of the invention is shown in FIG. 16. In FIG. 16, a player 2180 plays a hybrid game 2101 with Virtual Currency ("VRC") which has been given to the player under one or more business models, and/or real world credits ("RC") which has been purchased by the player with currency or currency equivalents. The player 2180 plays the entertainment game until a game play session reaches a particular state. When the particular state is reached, the player 2180 is given the opportunity to purchase an in-game object and/or factor (IgO). The IgO allows the gambling hybrid game to produce quanta 2110 which is credit that the player may use in the entertainment game 2103. Quanta 2110 is a type of game credit which may be used in the entertainment game 2103 to modify the game state or status; or to purchase or acquire certain other game objects or factors; or in some other way affect the game state of entertainment game 2103. The offer is extended by a portion of the gambling hybrid game 2101, or another function or process 2112 such as an on-line "store".

The player elects to purchase the offered IgO 2113 by paying currency or currency equivalent credits for the IgO 2113. The IgO purchased 2113 is inserted into or becomes present in the entertainment game in some manner. One skilled in the art will note, although not necessary, that the IgO 2113 has some context in the entertainment game 2103. One example of such an IgO would be a magic lizard that throws off charm. In this example, the charm might be thought of as quanta 2110. The IgO 2113 acquired would typically become visible to the player in the entertainment game 2103 in some manner appropriate for the game, such as in the example provided here, the lizard following the player's avatar or controlled entity around in the entertainment game.

As a function of buying the IgO 2113, a function 2111 which allows results from the wagering engine (wins, losses or draws) to produce quanta 2110 becomes available for use in the entertainment game 2103. In various embodiments, the funds which the player pays for the IgO 2113 are distributed through a function 2114 into three or more segments. A first segment 2115 is distributed to an operator for the costs of operating the on-line "store" 2112 where the IgO 2113 is purchased and/or profits for the enterprise. A second segment 2116 is distributed to provide funds for real money pay back to the player for wins on the RWE 2104 in the form of RC. A third segment 2117 is distributed to a pool of funds for use for funding prizes for tournaments in which the player may become eligible to compete. The distribution of the funds described is by way of example only and many other types and combinations of distributions may be made without departing from these embodiments.

Furthermore one skilled in the art will recognize that the following changes may be made to the process without departing from these embodiments:

(a) the IgO 2113 unlocks only GWC production by the gambling hybrid game 2101, or modifying the rate at which GWC is earned in the game;

(b) the IgO 2113 unlocks both quanta 2110 and GWC;

(c) the IgO 2113 unlocks or changes the rate of EE production by the RWE 2104;

(d) the IgO 2113 changes the rate of VRC or RC production by the RWE 2104, or changes the RWE pay tables; and/or (e) the IgO 2113 funds other segments for other funds.

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. A network distributed processing system, comprising:

a mobile computing device connected to a controller by a network, wherein the mobile computing device is configured to:

execute an interactive entertainment game of skill for a player;

communicate to the controller via the network, a status update about the interactive entertainment game of skill;

receive from the controller via the network, a change in a set of entertainment variables of the interactive entertainment game of skill;

generate a set of choices associated with the set of entertainment variables of the interactive entertainment game of skill; and incorporate into the interactive entertainment game of skill, the selected change in the set of entertainment variables of the interactive entertainment game of skill;

a server connected to the controller via a communication link, wherein the server is constructed to:

receive from the controller via the communication link, a trigger of a gambling event of a wager of real world credits;

execute the wager of real world credits in accordance with a regulated gambling proposition to determine a result of the gambling event; and communicate to the controller via the communication link, the result of the gambling event; and the controller connected to the mobile computing device by the network and connected to the server by the communication link, wherein the controller is configured to:

receive from the mobile computing device via the network, the status update about the interactive entertainment game of skill;

determine the trigger of the gambling event using the status update about the entertainment game;

communicate to the server via the communication link, the trigger of the gambling event;

receive from the server via the communication link, the result of the gambling event;

determine an amount of a convertible intermediate value holder to provide to the player based on the result of the gambling event;

provide the amount of the convertible intermediate value holder to a process that generates the set of choices associated with the set of entertainment variables of the interactive entertainment game of skill by converting a certain amount of the convertible intermediate value holder to the change in a set of entertainment variables of the interactive entertainment game of skill; and communicate to the mobile computing device via network, the change in the set of entertainment variables of the interactive entertainment game of skill.

2. The network distributed processing system of claim 1, wherein the controller is constructed to perform the process to convert the certain amount of convertible intermediate value holder into the change in the set of entertainment variables.

3. The network distributed processing system of claim 1, wherein the mobile computing device is constructed to perform the process to convert the certain amount of convertible intermediate value holder into the change in the set of entertainment variables.

4. The network distributed processing system of claim 1, wherein the controller further is constructed to update a player account with the amount of convertible intermediate value holder obtained based on the result of the gambling event.

5. The network distributed processing system of claim 1, wherein the process to generate the set of choices associated with the set of entertainment variables of the interactive entertainment game of skill by converting the certain amount of the convertible intermediate value holder bases the conversion on an input from at least one of a player management system, gambling hybrid game logic, and a third party system.

6. The network distributed processing system of claim 1, wherein the controller is further constructed to convert a certain amount of the convertible intermediate value holder to a certain amount of at least one of real world credits and game world credits.

7. The network distributed processing system of claim 1, wherein the controller and the server are constructed from a same processing apparatus.

8. The network distributed processing system of claim 1, wherein the controller and the server are constructed from different processing apparatuses, and wherein the communication link utilizes the network.

* * * * *